US011710377B2

(12) United States Patent
Leupp

(10) Patent No.: US 11,710,377 B2
(45) Date of Patent: Jul. 25, 2023

(54) SYMBOL UPGRADE WAVE

(71) Applicant: IGT, Las Vegas, NV (US)

(72) Inventor: Jon Leupp, Pleasant Hill, CA (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 17/358,201

(22) Filed: Jun. 25, 2021

(65) Prior Publication Data

US 2022/0415130 A1 Dec. 29, 2022

(51) Int. Cl.
*G07F 17/32* (2006.01)
*G07F 17/34* (2006.01)

(52) U.S. Cl.
CPC ..... *G07F 17/3267* (2013.01); *G07F 17/3213* (2013.01); *G07F 17/34* (2013.01)

(58) Field of Classification Search
CPC .. G07F 17/3267; G07F 17/34; G07F 17/3213; G07F 17/3258
See application file for complete search history.

(56) References Cited

U.S. PATENT DOCUMENTS 6,328,649 B1 * 12/2001 Randall ..... G07F 17/34 463/20
8,147,334 B2 4/2012 Gatto et al.
8,764,566 B2 7/2014 Miltenberger et al.
2008/0032784 A1 * 2/2008 Englman ..... G07F 17/34 463/21
2012/0172106 A1 * 7/2012 Caputo ..... G07F 17/3244 463/20
2014/0274294 A1 * 9/2014 Baerlocher ..... G07F 17/326 463/20
2017/0193738 A1 * 7/2017 Meyer ..... G07F 17/34
2019/0026976 A1 * 1/2019 Casey ..... G07F 17/3251
2019/0026977 A1 * 1/2019 Bolling, Jr. ..... G06Q 50/34
2019/0287336 A1 * 9/2019 Prabhu ..... G07F 17/3255

* cited by examiner

*Primary Examiner* — Justin L Myhr
(74) *Attorney, Agent, or Firm* — Sheridan Ross P.C.

(57) ABSTRACT

The present disclosure includes an illustrative method that includes initiating a first play of a game, where the game includes an array of cells; rendering a first distribution of symbols in the array of cells, where each cell in the array of cells includes a discrete symbol in the first distribution of symbols; determining that the first distribution of symbols qualifies for a symbol upgrade, where the set of symbols include a first symbol type; identifying each symbol in the first distribution of symbols that includes the first symbol type; and automatically performing the symbol upgrade, where each symbol in the set of symbols as well as at least one additional symbol not in the set of symbols are upgraded from the first symbol type to a second symbol type.

20 Claims, 17 Drawing Sheets

304

| s06 | s02 | s03 | s04 | s05 |
|---|---|---|---|---|
| s05 | s05 | s05 | s05 | s04 |
| s03 | s03 | s03 | s04 | s06 |

Fig. 4A

304

| s06 | s02 | s03 | s04 | s05 <-> s04 |
|---|---|---|---|---|
| s05 <-> s04 | s05 <-> s04 | s05 <-> s04 | s05 <-> s04 | s04 |
| s03 | s03 | s03 | s04 | s06 |

Fig. 4B

SYMBOL UPGRADE WAVE

BACKGROUND

The present disclosure is generally directed to gaming systems and, in particular, toward gaming systems that enable automated symbol upgrades.

Gaming machines typically offer a number of built-in game play features that contribute to the overall player experience. Any type of game play feature that presents the player with an additional opportunity to win is often viewed as desirable and can lead to increased play of the gaming machine.

BRIEF SUMMARY

In certain embodiments, the present disclosure relates to a gaming device, a method, and a system that provide automated symbol upgrade functions. In some embodiments, a gaming device is provided, included: a display; a processor coupled to the display; and a memory coupled with the processor and storing therein instructions that, when executed by the processor, cause the processor to: initiate a first play of a game, wherein the game comprises an array of cells; render, by the display in response to initiating the first play of the game, a first distribution of symbols in the array of cells, wherein each cell in the array of cells comprises a discrete symbol in the first distribution of symbols; determine, based on an arrangement of a set of symbols in the first distribution of symbols, that the first distribution of symbols qualifies for a symbol upgrade; identify, in response to determining that the first distribution of symbols qualifies for the symbol upgrade, each symbol in the set of symbols as well as at least one additional symbol not in the set of symbols to upgrade from a first symbol type to a second symbol type; automatically initiate the symbol upgrade in response to identifying each symbol in the set of symbols as well as the at least one additional symbol not in the set of symbols; and render, by the display in response to the symbol upgrade, a second distribution of symbols in the array of cells, wherein the second distribution of symbols comprises the second symbol type for each symbol in the set of symbols as well as the at least one additional symbol not in the set of symbols.

In some embodiments, a method is provided, including: initiating, with a processor, a first play of a game, wherein the game comprises an array of cells; rendering, on a display and in response to initiating the first play of the game, a first distribution of symbols in the array of cells, wherein each cell in the array of cells comprises a discrete symbol in the first distribution of symbols; determining, with the processor and based on an arrangement of a set of symbols in the first distribution of symbols, that the first distribution of symbols qualifies for a symbol upgrade, wherein the set of symbols comprise a first symbol type; identifying, with the processor and in response to determining that the first distribution of symbols qualifies for the symbol upgrade, each symbol in the first distribution of symbols that comprises the first symbol type; automatically performing, with the processor, the symbol upgrade, wherein each symbol in the set of symbols as well as at least one additional symbol not in the set of symbols are upgraded from the first symbol type to a second symbol type; and rendering, on the display and in response to the symbol upgrade, a second distribution of symbols in the array of cells, wherein the second distribution of symbols comprises the second symbol type for each symbol in the set of symbols as well as the at least one additional symbol not in the set of symbols.

In some embodiments, a system is provided, including: a processor; and a memory, coupled with the processor, comprising instructions that are executable by the processor, wherein the instructions comprise instructions that: initiate a first play of a game, wherein the game comprises an array of cells; cause a first distribution of symbols to be displayed in the array of cells, wherein each cell in the array of cells comprises a discrete symbol in the first distribution of symbols; determine, based on an arrangement of a set of symbols in the first distribution of symbols, that the first distribution of symbols qualifies for a symbol upgrade, wherein every symbol in the set of symbols comprises a first symbol type and wherein the set of symbols occupy adjacent cells in the array of cells; identify, in response to determining that the first distribution of symbols qualifies for the symbol upgrade, each symbol in the first distribution of symbols that comprises the first symbol type; perform the symbol upgrade such that each symbol in the set of symbols as well as at least one additional symbol not in the set of symbols are upgraded from the first symbol type to a second symbol type; and cause a second distribution of symbols to be displayed in the array of cells, wherein the second distribution of symbols comprises the second symbol type for each symbol in the set of symbols as well as the at least one additional symbol not in the set of symbols.

Additional features and advantages are described herein and will be apparent from the following Description and the figures.

BRIEF DESCRIPTION OF THE SEVERAL VIEWS OF THE DRAWINGS

FIG. 4A illustrates one example of a distribution of symbols in an array of cells;

FIG. 4B illustrates another example of a distribution of symbols in an array of cells;

DETAILED DESCRIPTION

Figure 1A:
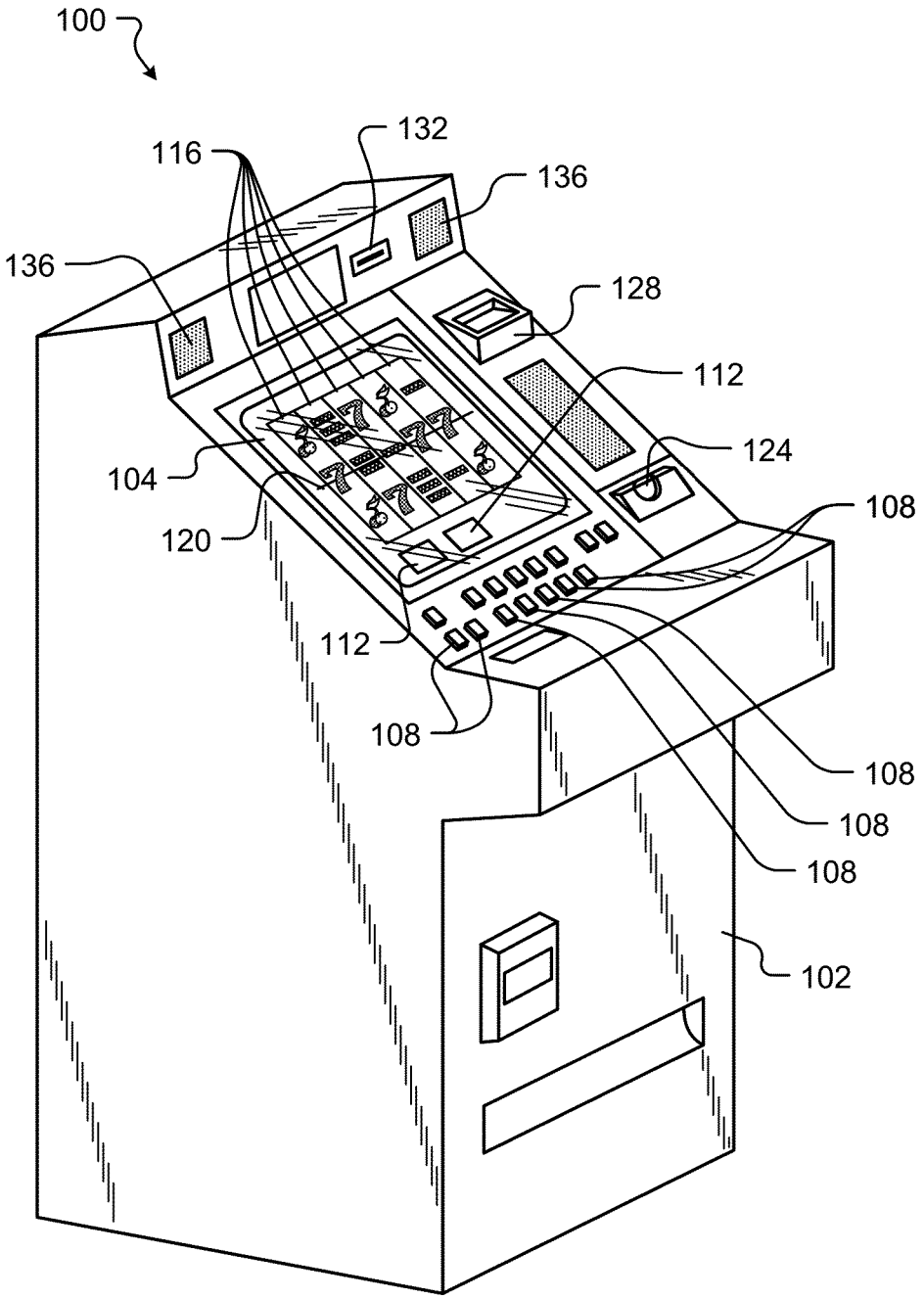
FIG. 1A depicts one example of a computational gaming device for enabling enhanced gaming features and symbol upgrade operations.

Embodiments of the present disclosure will be described in connection with gaming systems having one or multiple gaming devices that are capable of providing improved game features. Illustratively, a symbol upgrade or symbol upgrade wave is disclosed. In some examples described herein, game instructions are configured to cooperate with symbol upgrade instructions. The symbol upgrade instructions may enable the game instructions to automatically trigger and execute one, two, three, . . . , ten, or more symbol upgrades. As described herein a symbol upgrade may include upgrading a single symbol type once. A symbol upgrade may also include upgrading symbols more than once (e.g., a multi-upgrade or symbol upgrade wave).

In an embodiment of a reel game, after the reels of a slot game land and a first distribution of symbols is presented, any symbol types involved in any initial wins may be afforded a chance to be upgraded to a next highest symbol in a symbol hierarchy (e.g., a symbol may be eligible for upgrade to a next more valuable symbol). The symbol upgrade may be applied to all symbols of the same type, including those symbols in a cell that did not contribute to the initial win. If the upgrade is successful (e.g., a decision is made to upgrade the symbols that were previously eligible for an upgrade), all symbols of the same type may be upgraded and then may be eligible for an additional upgrade (e.g., a multi-upgrade or symbol upgrade wave). This additional opportunity for more symbol upgrades can result in a "wave" that sweeps more symbols into the final winning combinations. The potential of unlimited improvement to the outcome is an example feature that sets the multi-upgrade or symbol upgrade wave apart from traditional symbol upgrade features.

In some embodiments, every winning outcome can create anticipation, possibly in multiple stages, as even an initial low paying win can upgrade to a higher value symbol type, but also expand to additional lines and also into longer runs (e.g., one three-of-a-kind win could become multiple five-of-a-kind wins of a higher value symbol type). The proposed solution also creates especially suspenseful moments as the player can observe at times that a successful upgrade will draw in a number of other symbols not initially involved in the initial combination of winning symbols. When the other symbols are in key positions, the overall win can be improved and expanded, thereby creating more excitement and anticipation for the player, which can driver better player interactions.

In some embodiments, every winning outcome has the potential of becoming a larger event, sometimes brief when the single win upgrade attempt fails, and sometimes very dramatic as repeated successful upgrades turn small pays into big wins, with the extreme case of a three-of-a-kind win of the lowest value symbol type being upgraded completely such that a full screen blackout of the reels occurs with the higher value symbol type.

One possible mechanism for depicting an upgrade is to spin the symbols in place with the current symbol type on one side of a "card" and the next highest value symbol type being provided on the opposite side of the "card." In this example, the card may present the mechanism for viewing the symbol that is subject to being upgraded and the next symbol that would be presented if the upgrade occurs. While a two-dimensional object like a card is one example of an object that can be used to present a viewing of the upgrade, other types of objects could be used (e.g., a three-sided prism, a four-sided prism, a cube, a hexagon, etc.) and different symbol types could be displayed on various sides of the object being presented during the upgrade or potential upgrade. If the object comes to rest after spinning and an upgraded version of the symbol type is shown, then all of the symbols subject to upgrade may be upgraded to the next more valuable symbol type.

A hierarchical representation of symbol types may be displayed in concert with the array of symbols to help the player understand the relative value of each symbol type. The hierarchical representation may also be used to highlight certain symbol types that are subject to upgrade or that have been upgraded to help the player understand whether their current play resulted in an upgrade or not. As an example, the hierarchical representation may include a visual ladder of symbols that can be used to highlight symbols involved in the upgrade, symbols involved in the outcome, and the relative value of the symbols. As a more specific but non-limiting example, the hierarchical representation may include one or more free spins in which all successful upgrades persist and the hierarchical representation may help communicate which symbols are no longer in the reel outcomes due to symbol upgrades. For example, if an upgrade occurs, then any symbol that has been upgraded to the next higher value symbol type may be removed or deemphasized from presentation via the hierarchical representation.

In some embodiments, the payout (determined outcome) may be based on the final outcome after all upgrade attempts have completed, though the initial outcome and each upgrade could result in sequential pays if desired. The decision to implement a symbol upgrade or multiple symbol upgrades can be made in a number of different ways and the different decision mechanisms may drive different level of excitement, payout, etc. As an example, the decision to upgrade symbols at any point in time (e.g., at least level of an upgrade during a multi-upgrade can have a predetermined likelihood (e.g., a 50/50 chance of occurring) or be determined based on the output of a Random Number Generator (RNG). Alternatively, the decision to upgrade symbols at a particular instance or for a multi-upgrade may include referencing a weighted table to determine the ultimate number of upgrades that should occur for a given win. Use of a weighted table may help the game designer craft and control a more compelling player experience as compared to a game that solely relies on an RNG to determine whether an upgrade occurs.

In some embodiments, a number of candidate symbols used in a game may include a Wild symbol as the top upgrade, which is advantageous because Wild symbols created by a high number of symbol upgrades may create or extend initial wins based on lower symbol types. Special cases may also be supported where the Wild symbol could upgrade to a 2× Wild, then a 3× Wild, etc. Moreover, more than two symbols could be involved in a spin. For instance, a wild could spin and upgrade to reveal a 2× Wild, then a 3× Wild, then a 5× Wild, and then back to a normal Wild. Special symbol types could be included in the upgrade attempts (e.g., symbol types not available for a normal spin are only available during upgrade attempts). For instance, while most Kings are spinning with a chance to upgrade to Aces, some of the Kings may present an opportunity to upgrade directly to a Wild (e.g., bypassing the upgrade to an Ace).

Gaming devices described herein may include a computational device, such as a slot machine or Electronic Gaming Machine (EGM), that implements a symbol upgrade or multi-symbol upgrade process. While embodiments of the present disclosure will be described in connection with the example of a slot machine, or EGM implementing symbol upgrade or multi-symbol upgrade process, it should be appreciated that embodiments of the present disclosure are not so limited. For instance, other types of computational devices, such as portable user devices, smartphones, tablets, laptops, Personal Computers (PCs), wearable devices, etc. may be used to implement game enhancement features as part of a game as described herein. Furthermore, it should be appreciated that embodiments of the present disclosure may apply to games other than slot games or reel-based games. For instance, embodiments of the present disclosure may be used in connection with any type of game such as bingo, keno, slots, matching games, table games, etc.

The symbol upgrade operations and associated features may be activated, as described herein, during play of a game (e.g., a grid-based game), after a play of the game, and/or prior to a play of the game. As mentioned above, improved symbol operation may be made available within the context of a slot game, a matching game, a bingo game, a keno game, a poker machine, a game of skill, or in any other game that awards particular symbol combinations relative to positions on a user interface.

Among other things, embodiments of the present disclosure provide a player with more ways to win a game, heightened anticipation during gameplay, the ability to alter the chances of winning in a game, the ability to alter the payout amount for a winning game outcome, the ability to control whether multi-upgrade events occur rather than relying on a RNG, and/or add excitement to the overall game-playing experience of games.

Figure 1B:
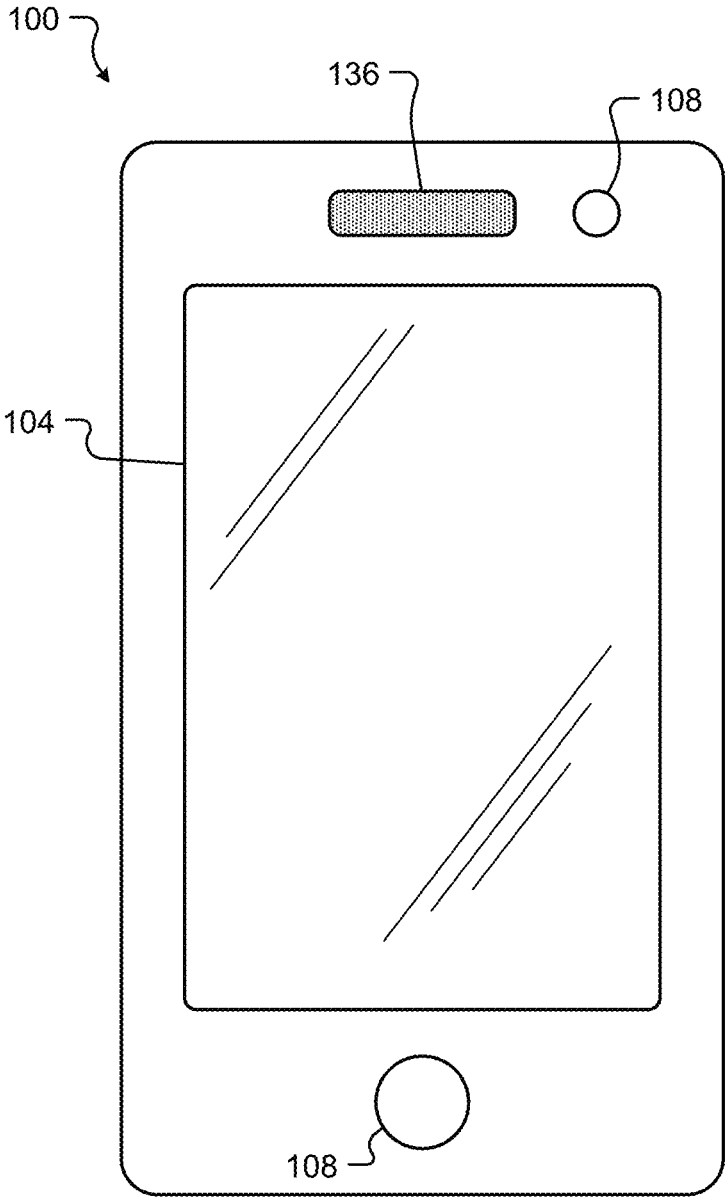
FIG. 1B depicts another example of a computational gaming device for enabling enhanced gaming features and symbol upgrade operations.

With reference now to FIGS. 1A and 1B, an illustrative computational device 100 that may be used to implement a grid-based game or the like will be described in accordance with at least some embodiments of the present disclosure. A computational device 100 may include a portable or non-portable device used for executing a gaming application or multiple different gaming applications without departing from the scope of the present disclosure. Non-limiting examples of a computational device include an EGM, a Video Gaming Machine (VGM), a mobile communication device (e.g., a smartphone, laptop, tablet, wearable device, etc.), a personal computer (PC), etc. An EGM or VGM-type of computational device 100 is shown in FIG. 1A in accordance with embodiments of the present disclosure.

The illustrative computational device 100 of FIG. 1A is shown to include a support structure, housing or cabinet, 102 which provides support for a plurality of displays, inputs, controls and other features of a conventional gaming machine. In the illustrated embodiment, a player plays the computational device 100 while sitting, however, the computational device 100 is alternatively configured so that a player can operate it while standing or sitting. The illustrated computational device 100 is positioned on the floor but can be positioned alternatively (i) on a base or stand, (ii) as a pub-style table-top game, (iii) as a stand-alone computational device on the floor of a casino with other stand-alone computational devices, or (iv) in any other suitable manner. The computational device 100 can be constructed with varying cabinet and display configurations.

In one embodiment, a computational device 100 is configured to randomly generate awards and/or other game outcomes based on probability data. Since a computational device 100 generates outcomes randomly or based upon a probability calculation, there is no certainty that the computational device 100 will provide the player with any specific award or other game outcome.

In some embodiments, a computational device 100 may employ a predetermined or finite set or pool of awards, progressive awards, prizes or other game outcomes. In such an embodiment, as each award or other game outcome is provided to the player, the computational device 100 removes the provided award or other game outcome from the predetermined set or pool. Once removed from the set or pool, the specific provided award or other game outcome cannot be provided to the player again. The computational device 100 may provide players with some or all of the available awards or other game outcomes over the course of a play cycle and may or may not guarantee a designated number of actual wins and losses.

The computational device 100 may include one or more displays 112. An illustrative display 112 may include a credit display that displays a player's current number of credits, cash, account balance or the equivalent. Another illustrative display 112 may include a bet display that displays a player's amount wagered.

The computational device 100 is also shown to include at least one payment acceptor. Illustrative payment acceptors may include, without limitation, a coin slot 124, where the player inserts coins or tokens, and a ticket, note, or bill acceptor 128, where the player inserts a bar-coded ticket, note, or cash. In one embodiment, a player-tracking card, credit card, debit card, or data card reader/validator 132 is also provided for accepting any of those or other types of cards as a form of payment toward playing a game on the computational device 100.

In one embodiment, a player inserts an identification card into card reader 132 of computational device 100. The identification card can be a smart card having a programmed microchip or a magnetic strip coded with a player's identification, credit totals, and other relevant information. In one embodiment, money may be transferred to a credit meter of the computational device 100 through an electronic fund transfer and card reader 132 using the player's credit, debit, or smart card. When a player funds the computational device 100, a processor of the computational device 100 may determine the amount of funds entered and the corresponding amount is shown on the credit or other suitable display 112 as described herein.

In one embodiment, after appropriate funding of computational device 100, the player presses an input device 108 to initiate game play. The input devices 108 may include various types of buttons, levers, gesture inputs, cameras, etc., that enable a player to start any game play or sequence of events. In one embodiment, upon appropriate funding, computational device 100 begins game play automatically. In another embodiment, the player may be required to actuate or activate one of the play buttons to initiate play of computational device 100. Other non-limiting types of input devices 108 may include a "bet one" button, a "max bet" button, or any other type of button known to be included in an EGM, VGM, or the like. It should further be appreciated that the input devices 108 may correspond to a physical button, a virtual button on a touch-screen of a game, an input element on a Graphical User Interface (GUI), or a combination thereof. In other words, the input devices 108 do not need to correspond to a physical button. In some embodiments, the player places a bet by pushing a "bet one" button (e.g., betting an amount equal to one credit for the next play). The player may increase the player's wager by one credit each time the player pushes "bet one" button. When the player pushes the "bet one" button, the number of credits shown in the credit display decreases by one, and the number of credits shown in the bet display increases by one. A "max bet" button can also be provided, which enables the player to bet the maximum wager (e.g., max lines, max wager per line, and re-spin operation). The computational device 100 may include other suitable wager buttons, such as a "repeat bet" button (e.g., repeating the bet made from the immediately last play of the computational device 100 for the next play of the computational device 100), one or more "select paylines" buttons, a "select re-spin operation" button, and one or more "select wager per payline" buttons.

Another type of input device 108 that may be provided on the computational device 100 is a physical cash out button, a virtual cash out button, a selectable GUI element, or the like. The player presses a cash out button and cashes-out to receive a cash payment or other suitable form of payment corresponding to the number of remaining credits. The player can receive coins or tokens in a coin payout tray or a ticket or credit slip, which are redeemable by a cashier or funded to the player's electronically-recordable identification card.

The computational device 100 may also include one or more display screens 104 and one or more sound generating devices 136. The combination of outputs provided on a display screen 104 and sound generating device 136 may contribute to the game play experience and, in some embodiments, may provide the player with information regarding a status of a game play event or sequence of events.

In one embodiment, the sound generating device 136 may include at least one speaker or other type of transducer for generating audible sounds, playing music, etc. In one embodiment, a computational device 100 provides dynamic sounds coupled with attractive multimedia images displayed on the display screen 104 to provide an audio-visual representation or to otherwise display full-motion video with sound to attract players to the computational device 100. During idle periods, the computational device 100 displays a sequence of audio and/or visual attraction messages to attract potential players to the computational device 100.

In one embodiment, a base or primary game includes a slot game with one or more paylines 120. As will be discussed in further detail herein, the game provided by the computational device 100 may support one or multiple paylines 120, which may extend across the display screen 104 vertically, horizontally, diagonally, at adjusted angles, etc. In some embodiments, such as for a slot game, a payline 120 intersects a plurality of reels 116, such as three to five reels. Each reel 116 may be used to display different sets of symbols in connection with game play activity provided by the computational device 100. In some embodiments, each reel 116 may operate independent of all other reels and the symbols displayed by a reel 116 at the end of a given spin may depend upon random numbers generated by the computational device 100. The positions of symbols on each reel 116 and in the combination of reels 116 may form the array of symbols distributed throughout an array of cells. The distribution of symbols may be presented in a presentation order rendered to the display screen 104 of the computational device 100.

The reels 116 may be provided in video form with simulated reels being displayed via the display screen 104. A reel 116 may be used to display any number of symbols such as bells, hearts, fruits, numbers, letters, bars or other images and symbols, which could correspond to a theme associated with a game provided by the computational device 100. The computational device 100 may be configured to award prizes, awards, or other game play opportunities when the reels 116 stop spinning and a particular symbol combination is intersected by an active payline 120 (e.g., a payline 120 that is currently being wagered and is subject to evaluation for a win after the reels 116 have stopped spinning and a distribution of symbols is finalized).

FIG. 1B illustrates another example of a computational device 100 in accordance with at least some embodiments of the present disclosure. This particular example of computational device 100 may correspond to a portable computational device 100 such as a mobile smartphone, tablet, wearable, etc. The computational device 100 may be owned by a user of the device 100 rather than being owned by a casino operator. In other embodiments, the portable computational device 100 may be owned by a casino operator and provided to a player for an amount of time, possibly under an agreement between the casino operator and the player. As an example, the portable computational device 100 may be assigned to the player for a duration of their visit or stay at the casino, but the portable computational device 100 may be returned by the player back to the casino operator after the visit or stay has concluded.

The computational device 100 includes a display screen 104, a plurality of input devices 108, and at least one speaker 136. In some embodiments, the display screen 104 may correspond to a touch-sensitive display screen, meaning that the display screen 104 is simultaneously capable of displaying information (e.g., in connection with game play activity) and receiving a user input. In some embodiments, the touch-sensitive display screen 104 may provide game features similar to a cabinet-style computational device 100 without requiring all of the dedicated buttons provided by a cabinet-style computational device 100.

Figure 2:
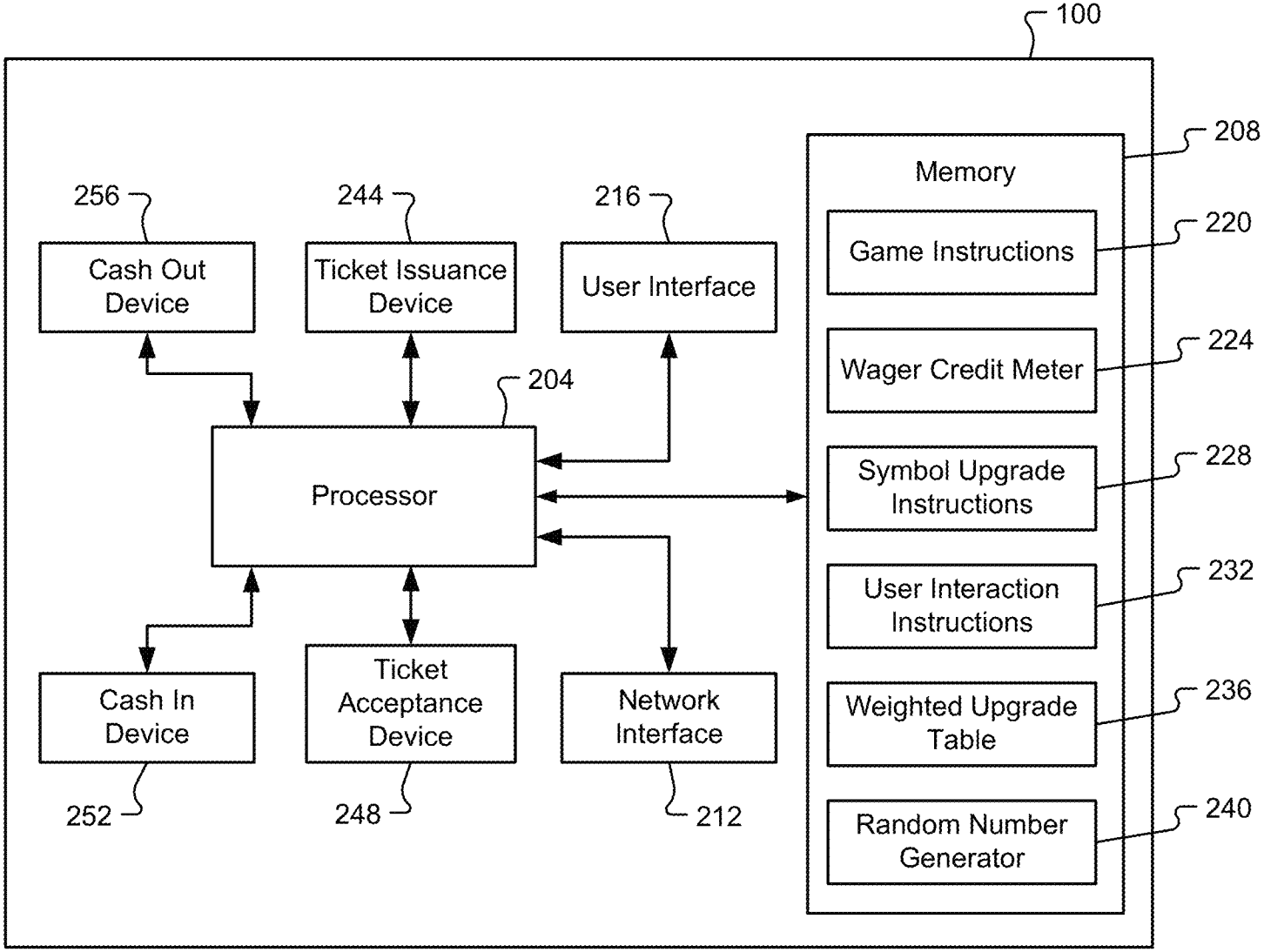
FIG. 2 is a block diagram depicting components of a computational gaming device for enabling enhanced gaming features and symbol upgrade operations.

With reference now to FIG. 2, additional details of the components that may be included in a computational device 100 will be described in accordance with at least some embodiments of the present disclosure. The computational device 100 is shown to include a processor 204, memory 208, a network interface 212, and a user interface 216. In some embodiments, the processor 204 may correspond to one or many microprocessors, Central Processing Units (CPUs), Graphics Processing Units (GPUs), microcontrollers, Integrated Circuit (IC) chips, or the like. The processor 204 may be configured to execute one or more instruction sets stored in memory 208. In some embodiments, the instruction stored in memory 208, when executed by the processor 204, may enable the computational device 100 to provide game play functionality as described herein.

The nature of the network interface 212 may depend upon whether the network interface 212 is provided in cabinet-style computational device 100 or a mobile computational device 100. Examples of a suitable network interface 212 include, without limitation, an Ethernet port, a Universal Serial Bus (USB) port, an RS-232 port, an RS-485 port, a network interface controller (NIC), an antenna, a driver circuit, a modulator/demodulator, a Slot Machine Interface Board (SMIB), etc. The network interface 212 may include one or multiple different network interfaces depending upon whether the computational device 100 is connecting to a single communication network or multiple different types of communication networks. For instance, the computational device 100 may be provided with both a wired network interface 212 and a wireless network interface 212 without departing from the scope of the present disclosure.

The user interface 216 may include a combination of the user input and user outputs described in connection with FIGS. 1A and 1B. For instance, the user interface 216 may include the display screen 104, the input devices 108, the speakers 136, or any other component that is capable of enabling user interaction with the computational device 100. The user interface 216 may also include one or more drivers for the various hardware components that enable user interaction with the computational device 100.

The memory 208 may include one or multiple computer memory devices that are volatile or non-volatile. The memory 208 may be configured to store instructions that enable player interaction with the computational device 100 and that enable game play at the computational device 100. Examples of instructions that may be stored in the memory 208 include game instructions 220, symbol upgrade instructions 228, and/or user interaction instructions 232. In addition to the instructions, the memory 208 may also be configured to store a weighted upgrade table 236 and/or RNG 240 that can be used by the game instructions 220, for example, to provide game outputs and/or determine whether or not to implement a symbol upgrade or multi-upgrade. The memory 220 may also be configured to store a wager credit meter 224 that is used to securely store wager history, available credit information, and other data related to wagers placed and game outcomes that occur at the computational device 100.

In some embodiments, the game instructions 220, when executed by the processor 204, may enable the computational device 100 to facilitate one or more games of chance or skill and produce interactions between the player and the game of chance or skill. In some embodiments, the game instructions 220 may include subroutines that present one or more graphics to the player via the user interface 216, subroutines that calculate whether a particular wager has resulted in a win or loss during the game of chance or skill, subroutines for determining payouts for the player in the event of a win, subroutines for exchanging communications with another device, such as a server, etc. The game instructions 220 may also be configured to call certain other instructions stored in memory 208 for purposes of enhancing gameplay features for a player. As an example, the game instructions 220 may be configured to automatically call symbol upgrade instructions 228 and/or user interaction instructions 232 based on a layout of symbols within an array of cells. For example, the game instructions 220 may be configured to automatically call the symbol upgrade instructions 228 in response to evaluating a distribution of symbols and determining that at least two adjacent cells include a common symbol.

When called by the game instructions 220, the processor 204 may then automatically begin executing the symbol upgrade instructions 228 to perform a symbol upgrade, to perform multiple symbol upgrades (e.g., a multi-upgrade), and the like. In a non-limiting example, the symbol upgrade instructions 228 may be automatically executed by the processor 204. The user interaction instructions 232 may then render an output via the display screen 104 that reflects the outputs of the symbol upgrade instructions 228 and/or game instructions 220. The user interaction instructions 232 may also be configured to present particular graphics while the symbol upgrade instructions 228 are being called by the game instructions 220 and while the symbol upgrade instructions 228 are making a determination of whether or not a symbol upgrade or multi-upgrade will occur. As an example, the user interaction instructions 232 may be configured to present spinning objects that display a current symbol or symbol type for a cell as well as a potential symbol or symbol type that would occupy a cell if a symbol upgrade or multi-symbol upgrade occurs. While depicted as separate instructions, it should be appreciated that the symbol upgrade instructions 228 may be included as part of the game instructions 220.

In some embodiments, the game instructions 220 may be configured to initiate a reel spin at the various reels 116 in connection with game play. In some embodiments, the random number generator 240 may be used to determine a final position of the reels 116 after the spin is completed. Alternatively or additionally, the game instructions 220 may utilize an output from the RNG 240 to determine a distribution of symbols in the array of cells. The game instructions 220 and/or symbol upgrade instructions 228 may utilize the weighted upgrade table 236 and/or RNG 240 to determine if a symbol upgrade or multi-upgrade should be performed. The game instructions 220 may also be configured to cooperated with the user interaction instructions 232 to present symbols via the display screen 104 when the reels 116 correspond to video reels or the like. The game instructions 220 may also be configured to evaluate a position of symbols relative to one or more paylines 120, relative to predetermined symbol areas, or cells in an array of cells, and any other evaluation desired to facilitate game play.

The credit meter 224 may be used to store or log information related to various player activities and events that occur at the computational device 100. The types of information that may be maintained in the credit meter 224 include, without limitation, player identification information, available credit information, wager amount information, game outcomes, and other types of information that may or may not need to be recorded for purposes of accounting for wagers placed at the computational device 100 and payouts made for a player during a game of chance or skill played at the computational device 100.

In some embodiments, the credit meter 224 may be configured to track coin in activity, coin out activity, coin drop activity, jackpot paid activity, credits applied activity, external bonus payout activity, voucher in activity, voucher out activity, timing of events that occur at the computational device 100, and the like. In some embodiments, certain portions of the credit meter 224 may be updated in response to outcomes of a game of chance or skill played at the computational device 100.

Additional details and functional capabilities of the symbol upgrade instructions 228 working in cooperation with the game instructions 220 will be described in connection with FIGS. 3-8.

The computational device 100 is further shown to include a ticket issuance device 244, a ticket acceptance device 248, a cash in device 252, and a cash out device 256. The ticket issuance device 244 may be configured to receive physical tickets, vouchers, or player loyalty cards. In some embodiments, the ticket issuance device 244 and ticket acceptance device 248 may operate in concert with the ticket acceptor 128. In such an embodiment, the ticket acceptor 128 may correspond to the physical components that receive and issue a ticket or voucher whereas the ticket issuance device 244 and the ticket acceptance device 248 correspond to the drivers and/or firmware components that control operation of the ticket acceptor 128. It should also be appreciated that the card reader 132 may be in communication with the ticket issuance device 244 and the ticket acceptance device 248 and may have functionality driven by one or both of these devices. For instance, the card reader 132 may correspond to the physical hardware components that receive information from a player loyalty card (or player loyalty application running on a mobile communication device, etc.) and that information may be processed by the ticket acceptance device 248 when receiving player credits from cards read by the card reader 132. The ticket issuance device 244 may provide the card reader 132 with information for applying wager credits back to a player card when a player is done with a game play session and wishes to transfer credits from the credit meter 224 back onto their card. Thus, the ticket issuance device 244 and ticket acceptance device 248 may also operate as a driver and/or firmware component for the card reader 132.

Similarly, the cash in device 252 and cash out device 256 may include or operate in concert with the coin slot 124 and any coin delivery mechanisms. The cash in device 252 and cash out device 256 may include hardware, drivers, or firmware that facilitate receiving or distributing cash, tokens, bills, etc. In some embodiments, the cash in device 252 may be configured to determine an amount of cash (e.g., in coins, bills, etc.), an amount or number of tokens, etc., input at the coin slot 124 and convert the values into credits for playing games with the game instructions 220. The cash out device 256 may correspond to hardware and software configured to output coins, tokens, bills, etc. if a player decides to cash out or convert playing credits back into cash, tokens, bills, etc.

Figure 3:
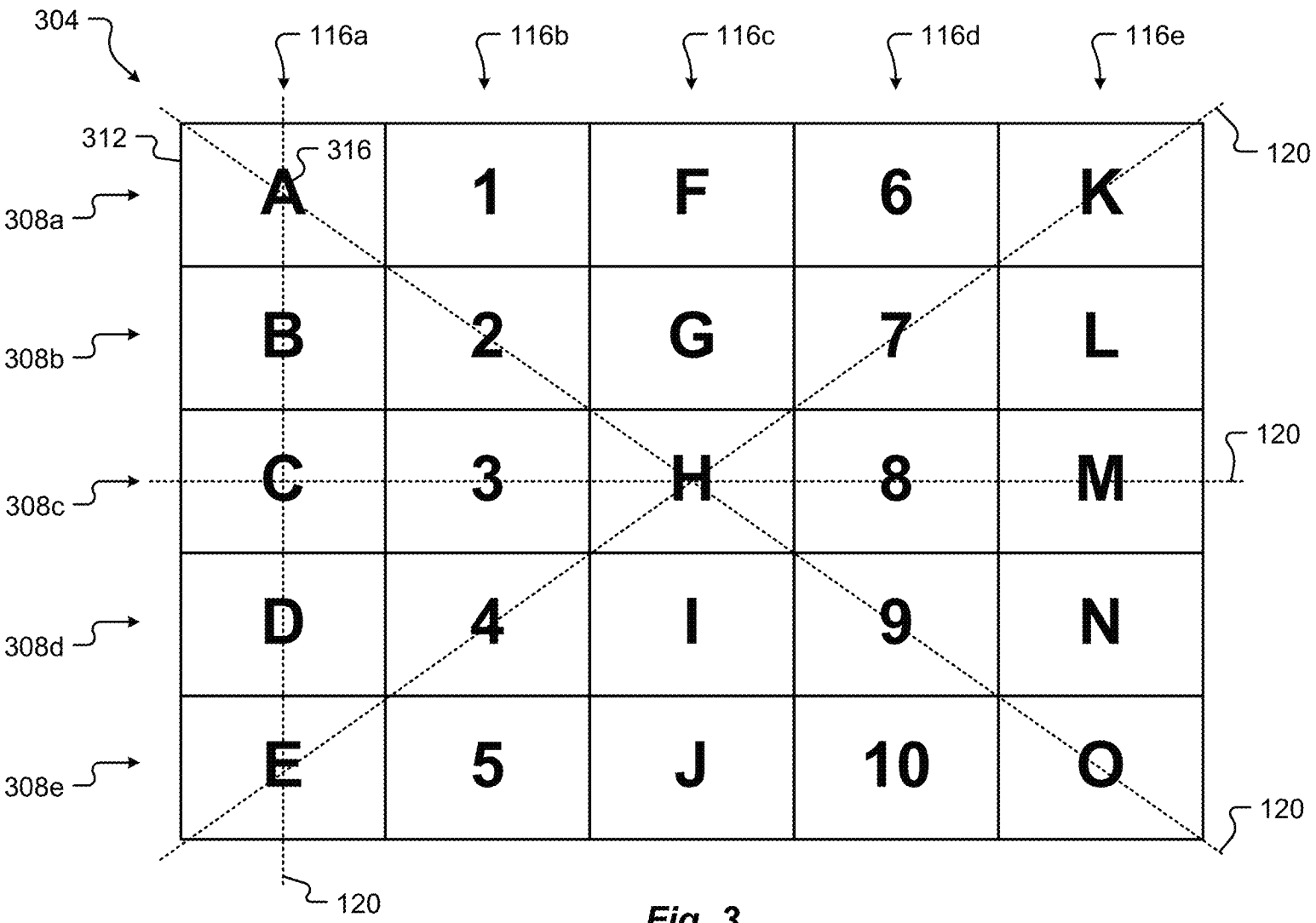
FIG. 3 is an illustrative layout of symbols rendered to an array of cells of a game.

With reference now to FIGS. 3 to 6D, various operations of the game instructions 220, the symbol upgrade instructions 228, and/or the user interaction instructions 232 will be described in accordance with at least some embodiments of the present disclosure. Referring initially to FIG. 3, a first distribution of symbols 316 (which may correspond to a particular symbol type) rendered to an array of cells 304 of a game will be described in accordance with embodiments of the present disclosure. The array of cells 304 may be presented, or otherwise rendered, with the display screen 104. In some embodiments, the game instructions 220, by using an output of the RNG 240, may control which particular symbols 316 are presented within a particular cell 312 in the array of cells 304. The illustrative array of cells 304 is shown to include five columns 116*a*, 116*b*, 116*c*, 116*d*, 116*e* of cells 312 and five rows 308*a*, 308*b*, 308*c*, 308*d*, 308*e* of cells 312. Although FIG. 3 illustrates a 5×5 array of cells 304, it should be appreciated that embodiments of the present disclosure can be implemented in an array of cells 304 having a variety of sizes. For instance, embodiments of the present disclosure may be used in an array of cells 304 that are 3×3, 3×5, 5×3, 7×3, 10×5, 10×10, etc. The example layout of the array of cells 304 should not be construed as limiting embodiments of the present disclosure.

As can be seen in FIG. 3, each cell 312 in the array of cells 304 may be populated with a single symbol 316 and the symbol 316 may correspond to a particular symbol type having a corresponding value associated therewith. The value of any particular symbol 316 may be based on its type and the payouts associated with the symbol type. In some embodiments, after the game instructions 220 has applied a RNG 232 to determine symbol 316 placement throughout the array of cells 304, there may be a 1:1 correlation of symbols 316 to cells 312. Each column 116*a*, 116*b*, 116*c*, 116*d*, 116*e* may also be referred to as a reel 116, particularly in the event that the game instructions 220 provides a slot game. If a slot game is implemented, then the reels 116 (e.g., in video form) are spun (e.g., virtually) and their final position after the spin is determined, at least in part, based on the output of the RNG 232. In some embodiments, a symbol 316 may correspond to an absence of a symbol or a blank symbol. This blank symbol may correspond to a symbol in a cell 312 having no value. Alternatively, a symbol 316 may correspond to a Wild symbol that has a variable value and can assume a number of different symbol types, dependent upon a best possible outcome of the symbol type in the cell 312 having the Wild symbol.

In some embodiments, payouts or other predetermined game outcomes (e.g., bonus spin opportunities, prize wins, cash wins, re-spin bonus plays, etc.) may be determined based on a symbol combination that falls on a payline 120 that is subject to a wager prior to the spin. In some embodiments, a plurality of the paylines 120 may be selected for "play" prior to a spin, meaning that any payline 120 selected for "play" will be evaluated for a predetermined symbol combination, or sequence of symbols 316. Examples of a sequence of symbols 316 may include, but are in no way limited to, at least one of the sequence [A; 1; F; 6; K] associated with the first row 308*a*, the sequence [B; 2; G; 7; L] associated with the second row 308*b*, the sequence [C; 3; H; 8; M] associated with the third row 308*c*, the sequence [D; 4; I; 9; N] associated with the fourth row 308*d*, the sequence [E; 5; J; 10; 0] associated with the fifth row 308*e*, and/or reverse sequences of the same. Additionally or alternatively, the sequence of symbols 316 may include, but are in no way limited to, a sequence of symbols 316 in an order along one or more of the vertical lines of cells 312 associated with the columns 116*a*-116*e* (e.g., the sequence [A; B; C; D; E], the sequence [1; 2; 3; 4; 5], etc., and/or reverse sequences of the same). In some embodiments, the sequence of symbols 316 may include, but are in no way limited to, a sequence of symbols 316 in an order along one or more of the cells 312 having a payline 120 running therethrough (e.g., the first diagonal payline sequence [A; 2; H; 9; 0], the second diagonal payline sequence [E; 4; H; 7; K], the first vertical payline sequence [A; B; C; D; E], the first horizonal payline sequence [C; 3; H; 8; M], etc., and/or reverse sequences of the same). In one embodiment, the sequence of symbols may comprise all sequences of symbols associated with each row 308*a*-308*e* and/or column 116*a*-116*e*. A selected payline 120 may also correspond to the payline 120 that is evaluated after a spin, but was wagered prior to the spin. In some embodiments, however, it may be possible to switch or select more paylines 120 for evaluation after a spin has completed, but before a subsequent play operation (e.g., respin, etc.) has been performed. The addition of more paylines 120 after the original spin but prior to the subsequent play operation may require the user to provide more credits to the game instructions 220 as part of enabling evaluation over more paylines 120. Although shown having four different linear paylines 120 (e.g., horizontal, vertical, diagonal, etc.), one or more paylines 120 may be associated with cells 312 in any shape the array of cells 304. In one embodiment, a payline 120 may run through a single row 308*a*-308*e* of the array of cells 304 (e.g., first row 308*a*, etc.). In some embodiments, a payline 120 may run through one or more columns 116*a*-116*e* in the array of cells 304. In any event, embodiments of the present disclosure are not limited to the position and/or shape of the paylines 120 shown in FIG. 3.

Referring now to FIGS. 4A-4K, various illustrative game play sequences that can be performed by the processor 204 in response to executing the game instructions 220, and/or the symbol upgrade instructions 228 will be described in accordance with at least some embodiments of the present disclosure. In some embodiments, FIGS. 4A-4K illustrate various presentations that are caused to be rendered by a display screen 104 of a computational device 100.

As shown in FIG. 4A, a first distribution of symbols 316 in the array of cells 304 may result in at least some of the cells 312 being populated by a common symbol type (e.g., symbol type s02, symbol type s03, symbol type s04, symbol type s05, symbol type s06, etc.). In some embodiments, the first distribution of symbols 316 may be determined by the game instructions 220 and based, at least in part, on an output of the RNG 240.

The example of FIG. 4A illustrates a scenario where the initial spin results (e.g., the first distribution of symbols 316) includes a three-of-a-kind match for symbol type s03 and a four-of-a-kind match for symbol type s05. The three-of-a-kind match for symbol type s03 is determined based on the adjacency of three cells 312 having the same symbol type s03. The four-of-a-kind match for symbol type s05 is determined based on the adjacency of four cells 312 having the same symbol type s05.

In response to the first distribution of symbols 316 having at least one winning combination (e.g., a three-of-a-kind match, a four-of-a-kind match, etc.), the game instructions 220 may automatically call the symbol upgrade instructions 228 to present an opportunity for a symbol upgrade or multi-upgrade and to implement the symbol upgrade or multi-upgrade if such an action is decided to be implemented. Initially, the symbol upgrade instructions 228 may attempt to upgrade all symbols of the lowest type (e.g., symbol type s05) to their next most valuable symbol type (e.g., symbol type s04).

FIG. 4B illustrates a presentation of the array of cells 304 while the symbol upgrade instructions 228 determine whether or not to upgrade the symbol type s05 to the next most valuable symbol type (e.g., symbol type s04). Specifically, FIG. 4B illustrates an animation of cells 312 that contain symbol type s05 that may be subject to the upgrade or multi-upgrade. In some embodiments, even symbols 316 that were not involved in the initial win (e.g., the symbol 316 not counted in the four-of-a-kind) may be a candidate for upgrade since it is the same symbol type s05 as the other symbols 316 that were involved in the initial win. During the animation, the cells 312 containing the symbol type s05 may have an object animation that depicts, at various times, the current symbol type s05 as well as the potential symbol type s04 if the upgrade occurs. As an example, the object may correspond to a card or other two-sided GUI element that is shown to spin, thereby depicting a front and back side of the card. The front side of the card may display the symbol type s05 whereas the back side of the card may depict the symbol type s04.

Figure 4D:
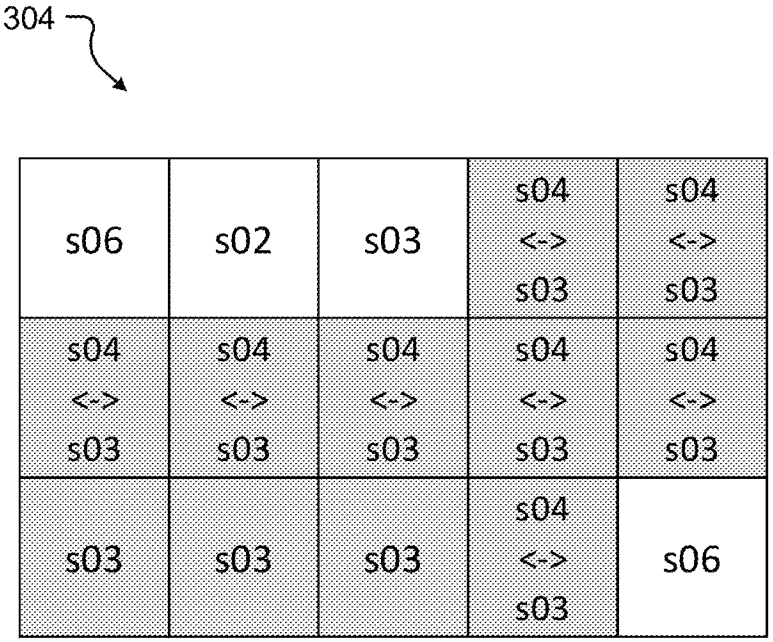
FIG. 4D illustrates a fourth example of a distribution of symbols in an array of cells.
Figure 4C:
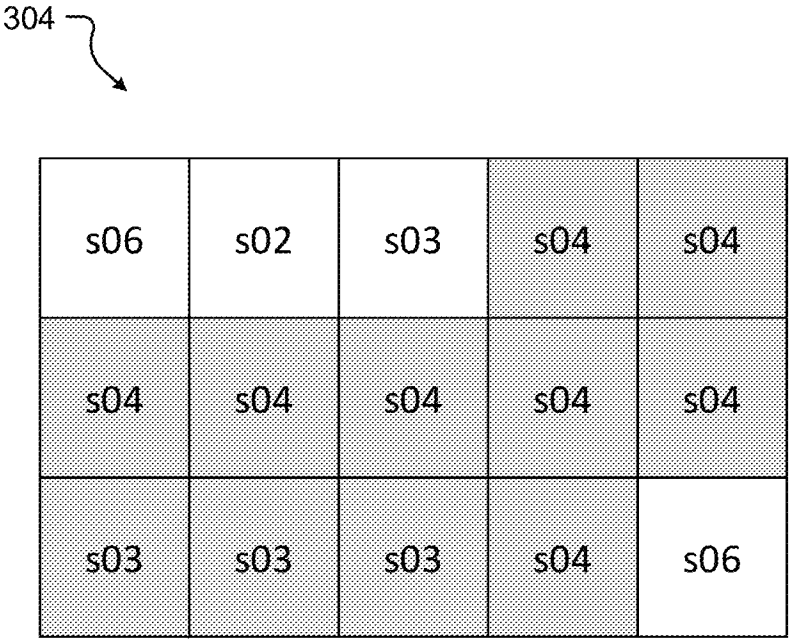
FIG. 4C illustrates a third example of a distribution of symbols in an array of cells.

FIG. 4C illustrates a presentation of the array of cells 304 if the symbol upgrade for the symbol type s05 is successful, meaning the symbol type s05 is upgraded to the new symbol type s04, which corresponds to a next more valuable symbol type. Because the symbols 316 initially involved in the four-of-a-kind match as well as the additional symbol 316 not involved in the four-of-a-kind match have been upgraded to the new symbol type s04, the distribution of symbols 316 now includes five cells 312 with the new symbol type s04 (e.g., those symbols 316 that were upgraded), plus three additional symbols 316 that were initially the symbol type s04. As shown in FIG. 4C, this means that eight symbols 316 may now be candidates for an additional symbol upgrade. The additional symbol upgrade may be considered a multi-upgrade since a first upgrade of the symbol type s05 has already occurred. The decision of whether or not to further upgrade the symbol type s04 to a new more valuable symbol type s03 may be made by the symbol upgrade instructions 228 with the assistance of the weighted upgrade table 236 and/or RNG 240.

FIG. 4D illustrates a presentation of the array of cells 304 while the additional symbol upgrade decision is made by the symbol upgrade instructions 228. Specifically, like the first symbol upgrade animation, the cells 312 containing the symbol type s04 may have an object animation that depicts, at various times, the current symbol type s04 as well as the potential symbol type s03 if the upgrade occurs. A spinning card may again be used to display the symbol type s04 and the next most valuable symbol type s03.

Figure 4F:
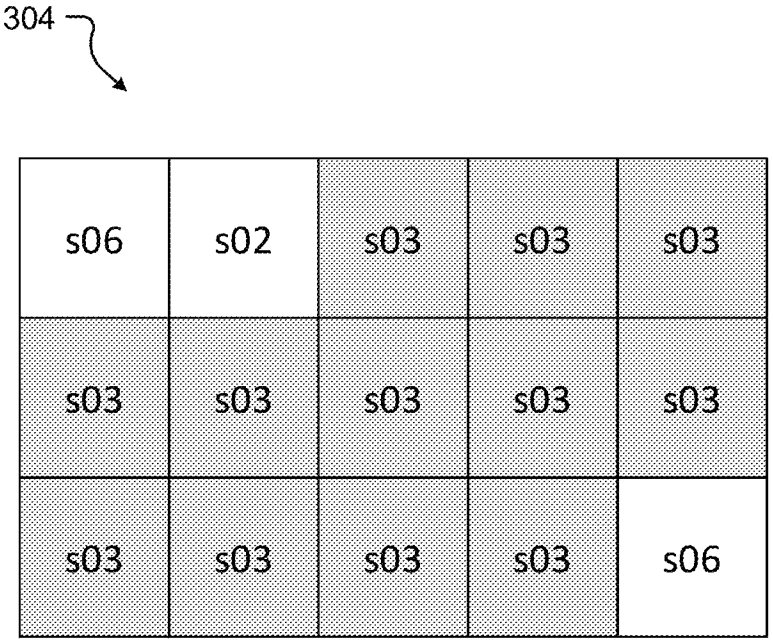
FIG. 4F illustrates a sixth example of a distribution of symbols in an array of cells.
Figure 4E:
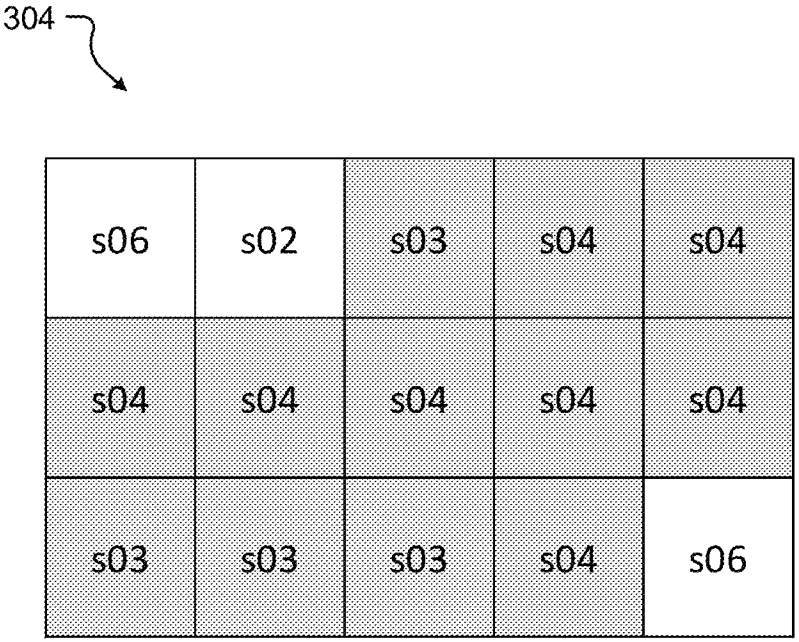
FIG. 4E illustrates a fifth example of a distribution of symbols in an array of cells.

FIG. 4E illustrates one example of a presentation of the array of cells 304 if the additional upgrade from FIG. 4D is not implemented. In this example, the seven cells 312 containing the symbol type s04 retain the symbol type s04 while all other cells 312 retain their original symbols 316. Once the symbol upgrade instructions 228 determine that no additional symbol upgrades will be performed, the game instructions 220 may then evaluate the array of cells 304 (e.g., by evaluating paylines 120 and a value of symbols 316 falling on particular or active paylines 120) to determine a game outcome.

Figure 4G:
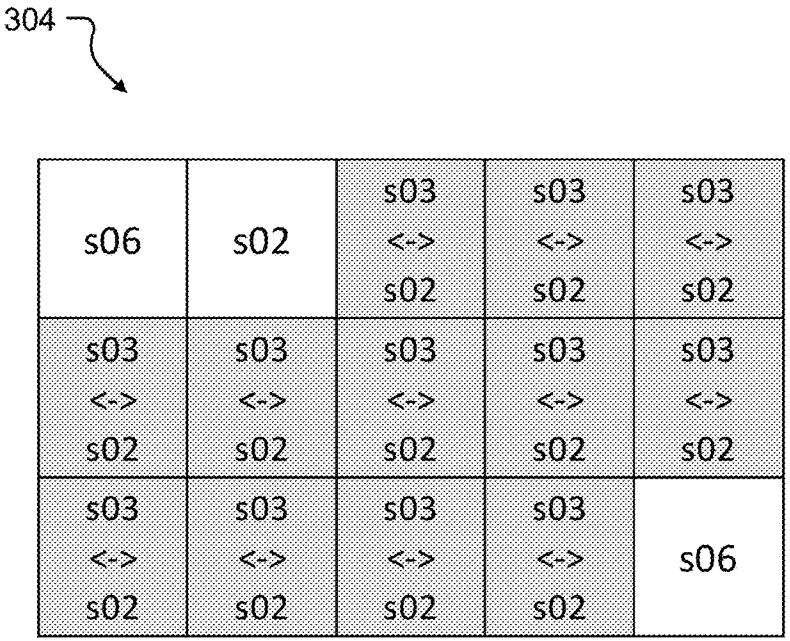
FIG. 4G illustrates a seventh example of a distribution of symbols in an array of cells.
Figure 4H:
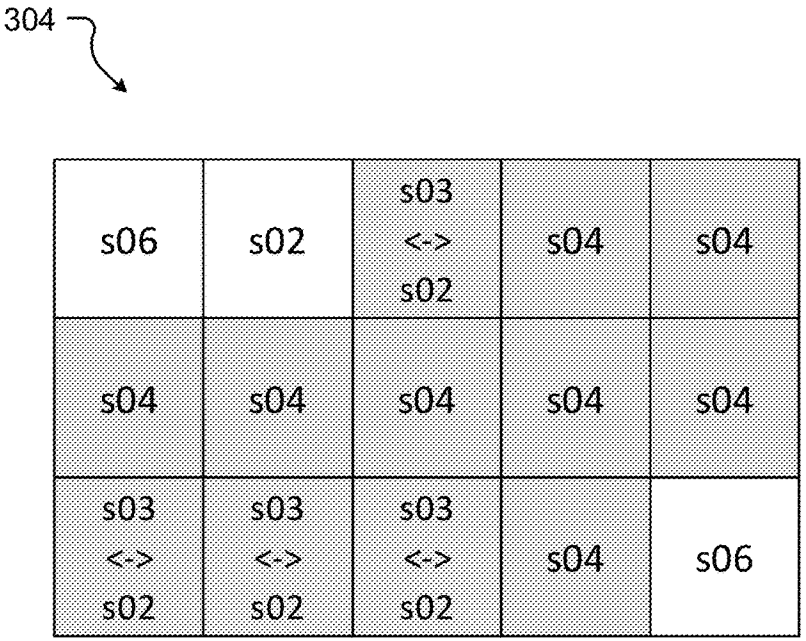
FIG. 4H illustrates an eighth example of a distribution of symbols in an array of cells.

Alternatively, as shown in FIG. 4F, the symbol upgrade instructions 228 may determine that the additional symbol upgrade should be implemented. In this scenario, the additional symbol upgrade for the symbol type s04 is successful, meaning the symbol type s04 is upgraded to the new symbol type s03, which corresponds to a next more valuable symbol type. Because the symbols 316 initially involved in the four-of-a-kind match as well as the additional symbol 316 not involved in the four-of-a-kind match have been upgraded to the new symbol type s04, and then the new symbol type s04 was further upgraded to symbol type s03, the distribution of symbols 316 now includes five cells 312 with the new symbol type s03 (e.g., those symbols 316 that were upgraded twice), plus seven additional symbols 316 that were initially the symbol type s04 or symbol type s03. This means that the array of cells 304 now contain twelve cells 312 of the new symbol type s03. The process of additional upgrades may occur for the scenario depicted in FIG. 4E or for the scenario depicted in FIG. 4F FIG. 4G illustrates one example of a presentation of the array of cells 304 if continuing from the state depicted in FIG. 4E whereas FIG. 4H illustrates a different example of a presentation of the array of cells 304 if continuing from the state depicted in FIG. 4F. Referring first to FIG. 4G, since symbol type s04 is no longer being upgraded, the symbol upgrade instructions 228 may still evaluate the three-of-a-kind initial win for an upgrade opportunity. Specifically, the three symbols 316 involved in the initial three-of-a-kind win as well as at least one additional symbol 316 not involved in the three-of-a-kind win may be candidates for upgrading to a next more valuable symbol type s02. Like the animations of FIGS. 4B and 4D, the cells 312 containing the symbol type s03 may have an object animation that depicts, at various times, the current symbol type s03 as well as the potential symbol type s02 if the upgrade occurs. A spinning card may again be used to display the symbol type s03 and the next most valuable symbol type s02.

Figure 4J:
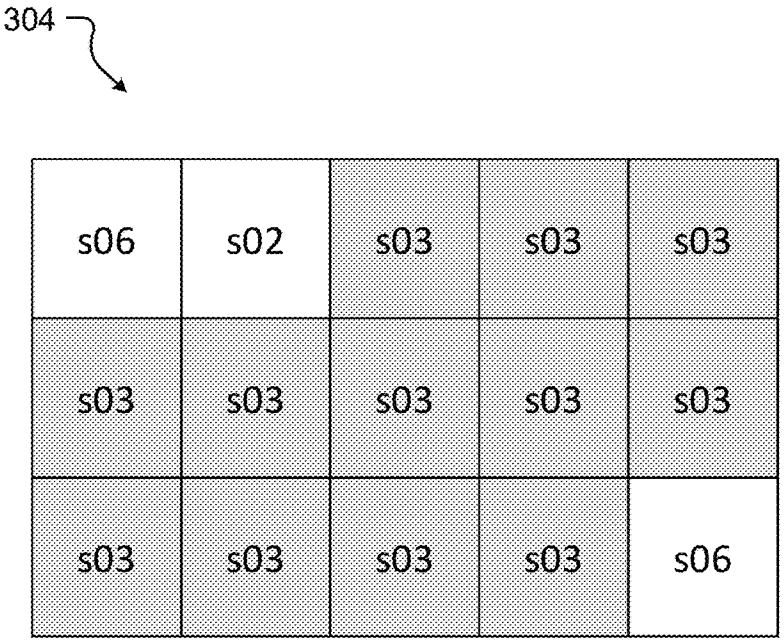
FIG. 4J illustrates a tenth example of a distribution of symbols in an array of cells.
Figure 4I:
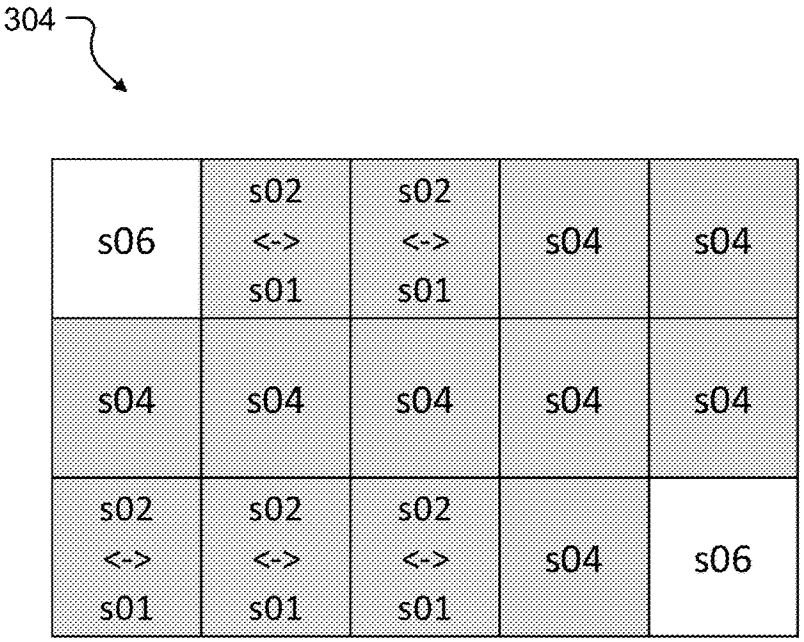
FIG. 4I illustrates a ninth example of a distribution of symbols in an array of cells.
Figure 4K:
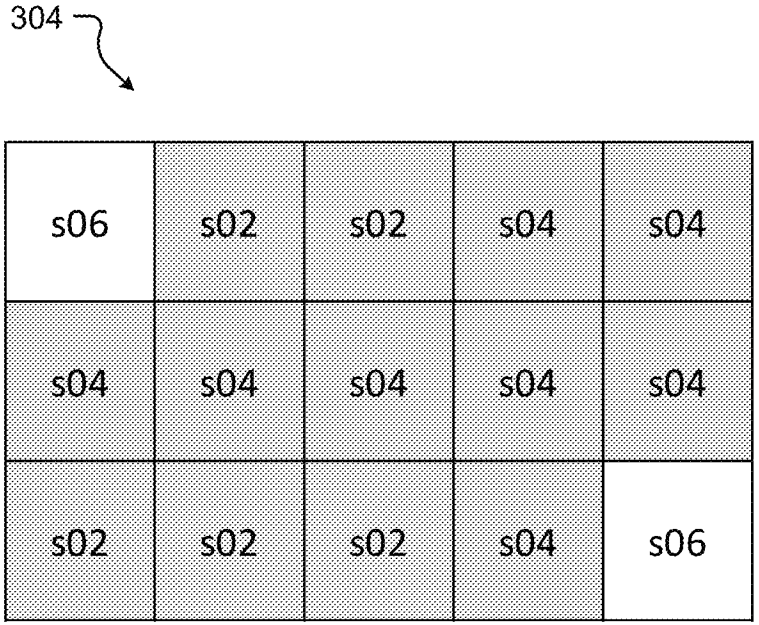
FIG. 4K illustrates an eleventh example of a distribution of symbols in an array of cells.

Continuing the example from FIG. 4G, if the symbol type s03 is upgraded to a new symbol type s02, then yet another upgrade opportunity may be evaluated by the symbol upgrade instructions 228 where it is determined if the symbol type s02 should be upgraded to a new more valuable symbol type s01, as is depicted in FIG. 4I. Again, the three symbols 316 involved in the initial three-of-a-kind win as well as two additional symbols 316 not involved in the three-of-a-kind win may be candidates for upgrading to a next more valuable symbol type s01. Like the animations of FIGS. 4B, 4D, and 4G, the cells 312 containing the symbol type s02 may have an object animation that depicts, at various times, the current symbol type s02 as well as the potential symbol type s01 if the upgrade occurs. A spinning card may again be used to display the symbol type s02 and the next most valuable symbol type s01. FIG. 4K illustrates an example of the array of cells 304 if the symbol type s02 is not upgraded to the new symbol type s01.

Referring back to the scenario of FIG. 4H, the symbol upgrade instructions 228 may continue to assess if another symbol upgrade from symbol type s03 to symbol type s02 should occur. At this point, the symbol upgrade instructions 228 may determine whether to upgrade all cells 312 containing the symbol 316 of the symbol type s03 to symbol type s02 regardless of whether or not the cells 312 contained symbols 316 involved in the initial win. FIG. 4J illustrates a presentation of the array of cells 304 if no additional upgrades are implemented.

While FIGS. 4A-4K depicted and described multiple stages of upgrades as being decided one after another, it should also be appreciated that the symbol upgrade instructions 228 may determine, in a single instance and immediately in response to the first win, whether and how many symbol upgrades will be performed. In other words, the symbol upgrade instructions 228 may determine after the first win how many symbol upgrades will occur and then leverage the user interaction instructions 232 to sequentially depict each of the determined upgrades (if multiple) in the multi-upgrade. The user interaction instructions 232 may still present animations sequentially in an attempt to provide the player with the appearance that decisions are being made sequentially and after each upgrade even though the symbol upgrade instructions 228 already made the decision on a multi-upgrade after the initial win. Presenting multiple upgrades to a player in this sequential manner can help create a heightened level of excitement and anticipation. Moreover, it can help the player understand when upgrades occur, the potential value of upgrades, and make the player feel as though they have a better understanding of the game and the upgrades. As will be described in further detail below, the symbol upgrade instructions 228 may utilize the weighted upgrade table 236 and/or RNG 240 to determine whether one or multiple symbol upgrades will occur in response to an initial win determination made by the game instructions 220.

Figure 5:
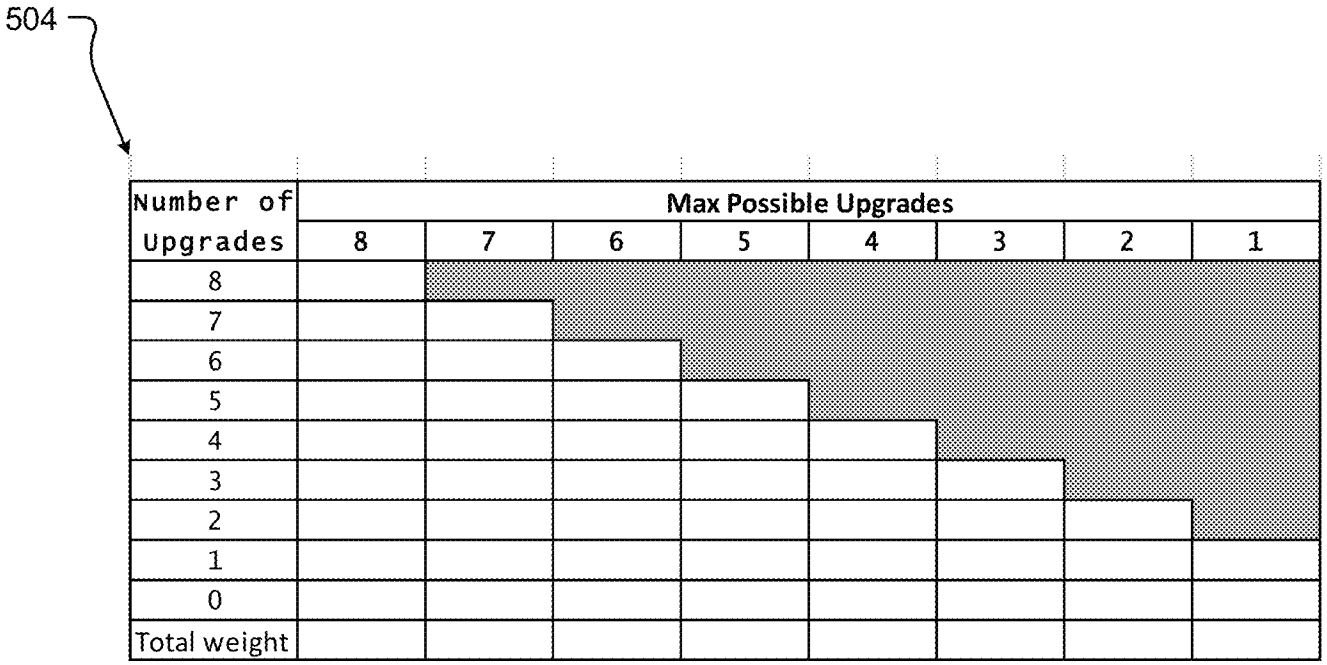
FIG. 5 illustrates an example of a weighted upgrade table to be used in determining a symbol upgrade.

FIG. 5 illustrates an example of a weighted upgrade table 236 that may be used by the symbol upgrade instructions 228 in connection with making a determination of whether or not to implement a single symbol upgrade or multiple symbol upgrades. In some embodiments, on every spin, if there are any symbols 316 that would be involved in line wins, there is a chance for each of the winning symbol types to upgrade to a higher symbol type in a symbol hierarchy. The number upgrades may be determined from a symbol climb base table 504 for a base game implemented by the game instructions 220, or a symbol climb bonus table 508 for bonus spins.

As discussed above, the symbols 316 may upgrade one symbol type at a time and any symbols 316 matching the upgraded symbol 316 can join the climb. For example, if there is a three-of-a-kind win for symbol type s08, and another symbol type s08 on a different reel (e.g., reel 5), and symbol type s08 is determined to upgrade twice, then all symbols 316 of symbol type s08 will upgrade to the next highest symbol which is the symbol type s07. Those symbols 316 will upgrade a second time, along with any additional symbols 316 of symbol type s07 on the reels, to symbol type s06. The number of upgrades can be determined independently per original winning symbol type, by using the weights in the appropriate column for Max Possible Upgrades. The number of possible upgrades is the number of upgrades it would take the given symbol to reach the top symbol, symbol type w01 (e.g., a Wild symbol).

In the base game, for example, the total number of possible upgrades may be a first number (e.g., eight) for the lowest line win symbol 316 (symbol type s08) and '1' for the second highest symbol 316 (symbol type s01). In the bonus game, previously upgraded symbols are removed from the ladder and the maximum possible upgrades may depend on the number of symbols remaining in the ladder. If determined climbs for multiple symbols overlap, the lower symbol type will upgrade to the highest symbol type determined to be reached by any of the overlapping upgrades. For example, if it is determined that symbol type s07 will upgrade to symbol type s04 (three upgrades), and symbol type s05 will upgrade to symbol type s02 (three upgrades), then symbol type s07 will simply upgrade to symbol type s02. If upgrade climbs for multiple symbols do not overlap, then after the lower symbol type has reached its final upgrade, the next lowest symbol type will begin its upgrade climb. Wins may be evaluated by the game instructions 220 only after all symbol climbs have been processed by the symbol upgrade instructions 228.

Figure 6A:
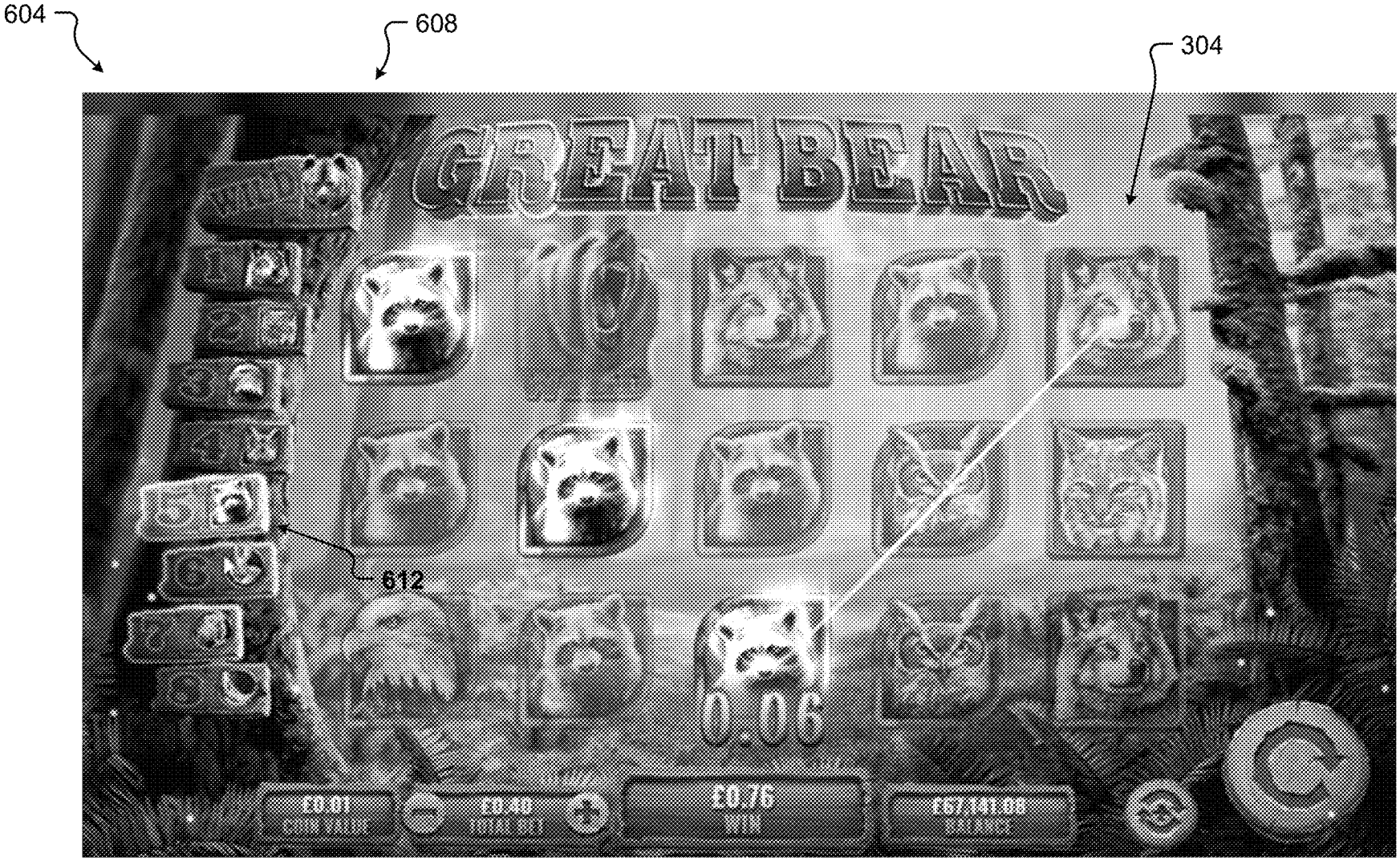
FIG. 6A illustrates a first example of a user interface displaying a number of graphical user interface (GUI) elements in an array of cells.

Referring now to FIGS. 6A-6D, additional game play sequences that can be performed by the processor 204 in response to executing the game instructions 220, the symbol upgrade instructions 228, and/or the user interaction instructions 232 will be described in accordance with at least some embodiments of the present disclosure. FIG. 6A illustrates a first presentation of GUI elements 604, which may be presented via the display screen 104. The GUI elements 604 are shown to include an array of cells 304 with symbols 316 distributed therein as well as a hierarchical representation of symbol types 608. The hierarchical representation of symbol types 608 may be configured to hierarchically display some or all of the symbol types that are represented by symbols 316 in the array of cells 304. In some embodiments, the hierarchical representation of symbol types 608 may be static and always present all possible symbol types such that a player, when viewing the hierarchical representation of symbol types 608, can intuitively understand a relative value of each symbol type used by the game instructions 220. Alternatively, the hierarchical representation of symbol types 608 may be dynamic and configured for modification.

In the example of FIG. 6A, the hierarchical representation of symbol types 608 may be modified to highlight a particular symbol type (e.g., Raccoon) that is currently involved in an upgrade or is a candidate for upgrade. An alternative approach could be to modify the hierarchical representation of symbol types 608 to minimize an appearance of symbol types that are either: (1) not currently displayed in the array of cells 304 or (2) not involved in or a possible candidate for an upgrade opportunity. As an example and as shown in FIG. 6D, as upgrades occur and lower value symbol types are no longer available for upgrade, a symbol GUI element 612 for those symbol types may be removed, minimized, or otherwise deemphasized in the hierarchical representation of symbol types 608, thereby allowing the player to focus on symbol types that are still candidates for upgrades.

Figure 6B:
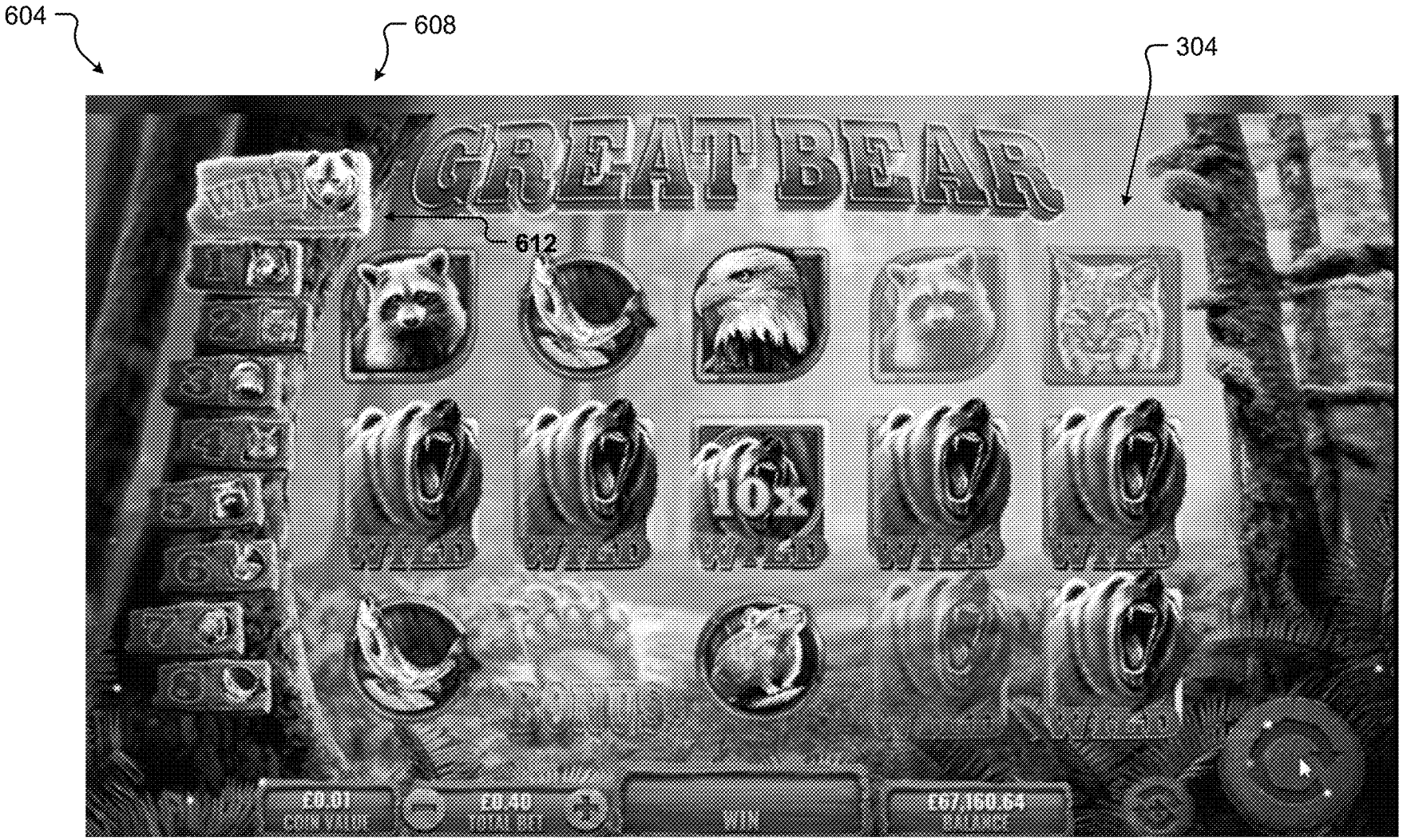
FIG. 6B illustrates a second example of a user interface displaying a number of GUI elements in an array of cells.

FIG. 6B illustrates another example of a dynamic hierarchical representation of symbol types 608 where a symbol GUI element 612 is highlighted to show the symbol type involved in a current win. Alternatively or additionally, the symbol GUI element 612 may be highlighted if symbols of that type are currently being considered for upgrade and/or if symbols of that type would be the resulting symbol type after an upgrade.

Figure 6C:
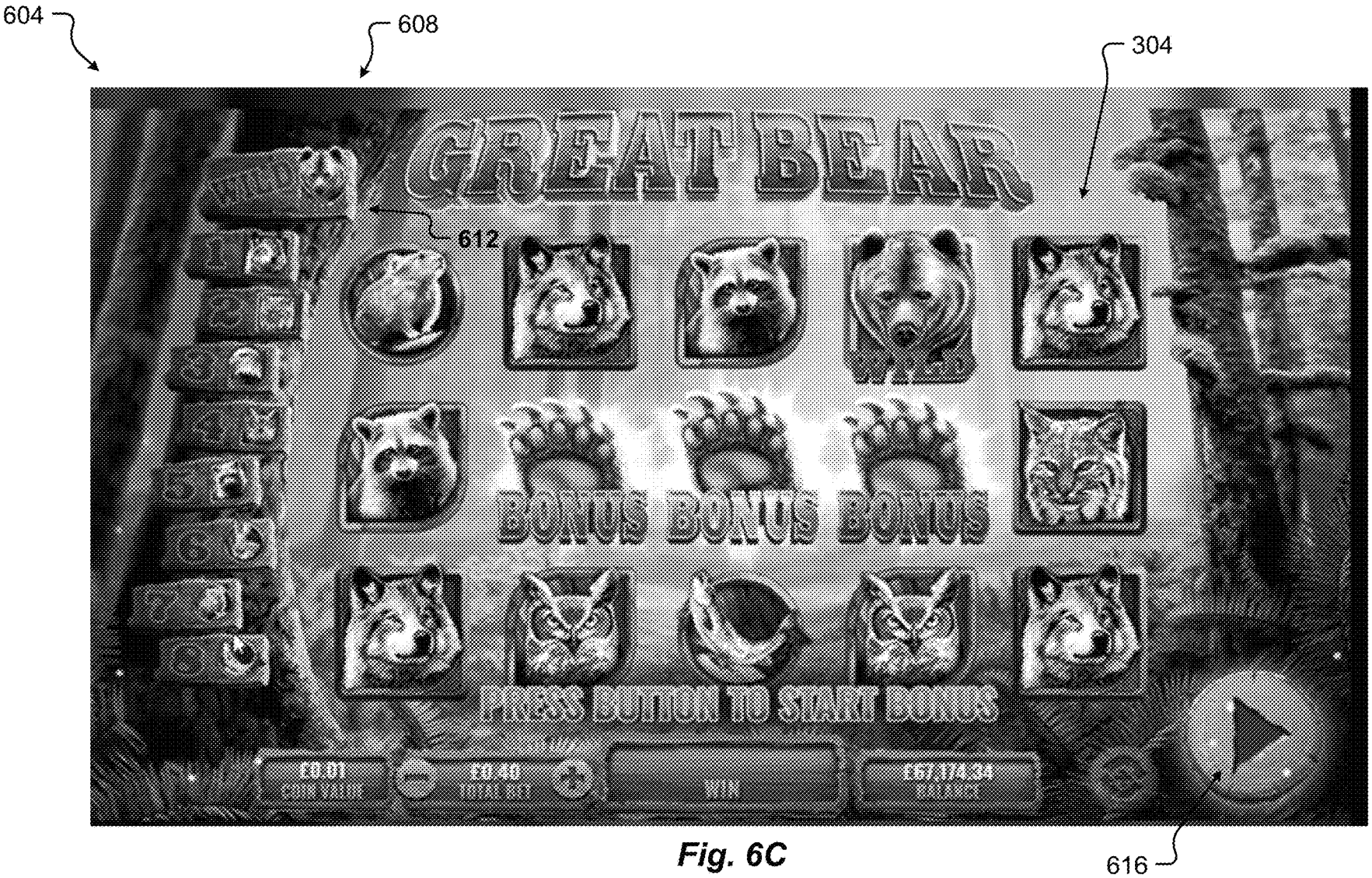
FIG. 6C illustrates a third example of a user interface displaying a number of GUI elements in an array of cells.
Figure 6D:
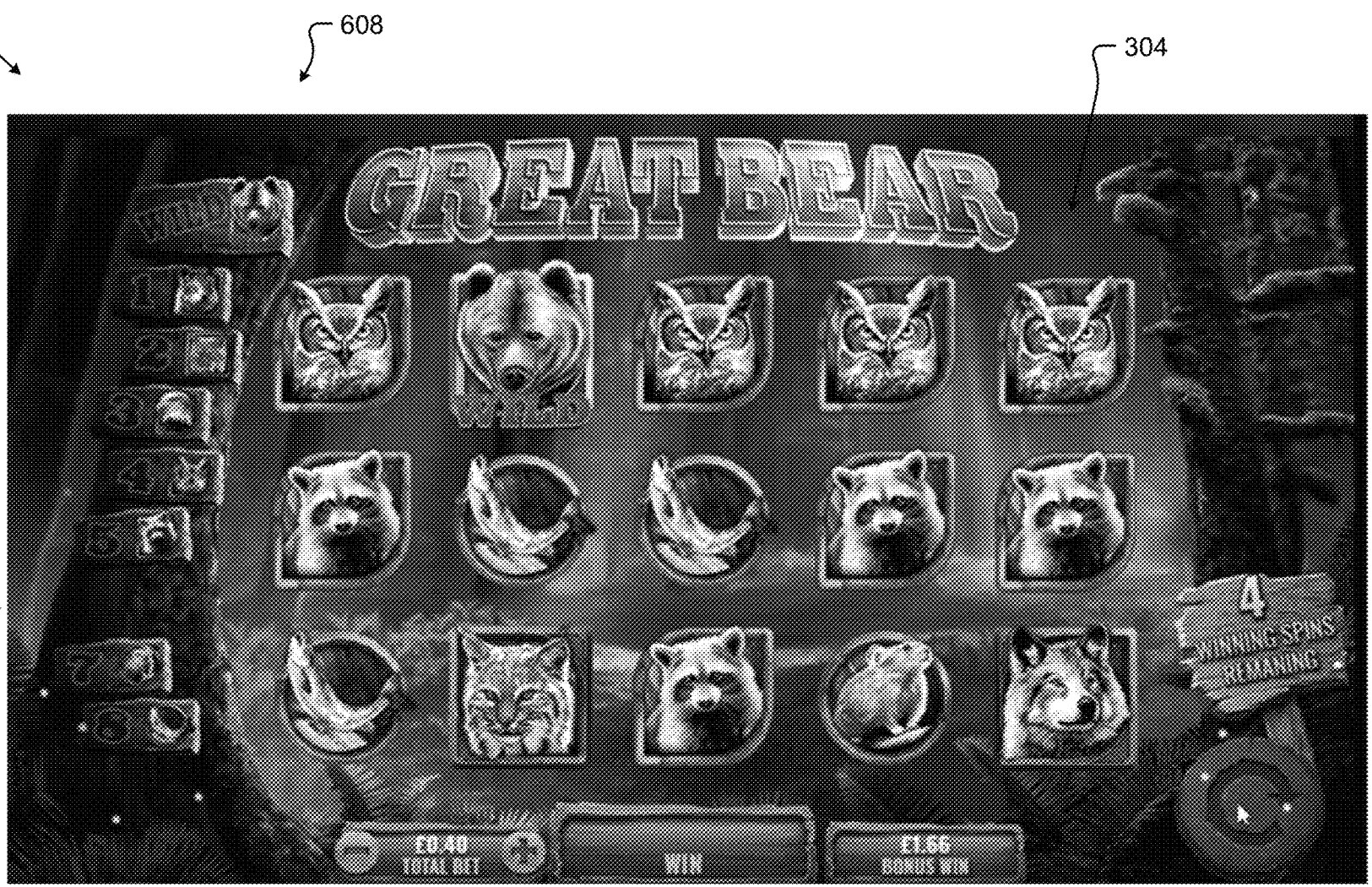
FIG. 6D illustrates a fourth example of a user interface displaying a number of GUI elements in an array of cells.

FIG. 6C illustrates another example of GUI elements 604 where a bonus spin opportunity is presented to a player. In this example, the GUI elements 604 may include an activates user input GUI element 616. When the player selected the user input GUI element 616 (possibly by hitting a physical button or by selecting the user input GUI element 616 via a touch-sensitive display). Selecting the user input GUI element 616 may cause the game instructions 220 to initiate a spin or bonus spin, which may trigger additional upgrade events as described herein.

Figure 7:
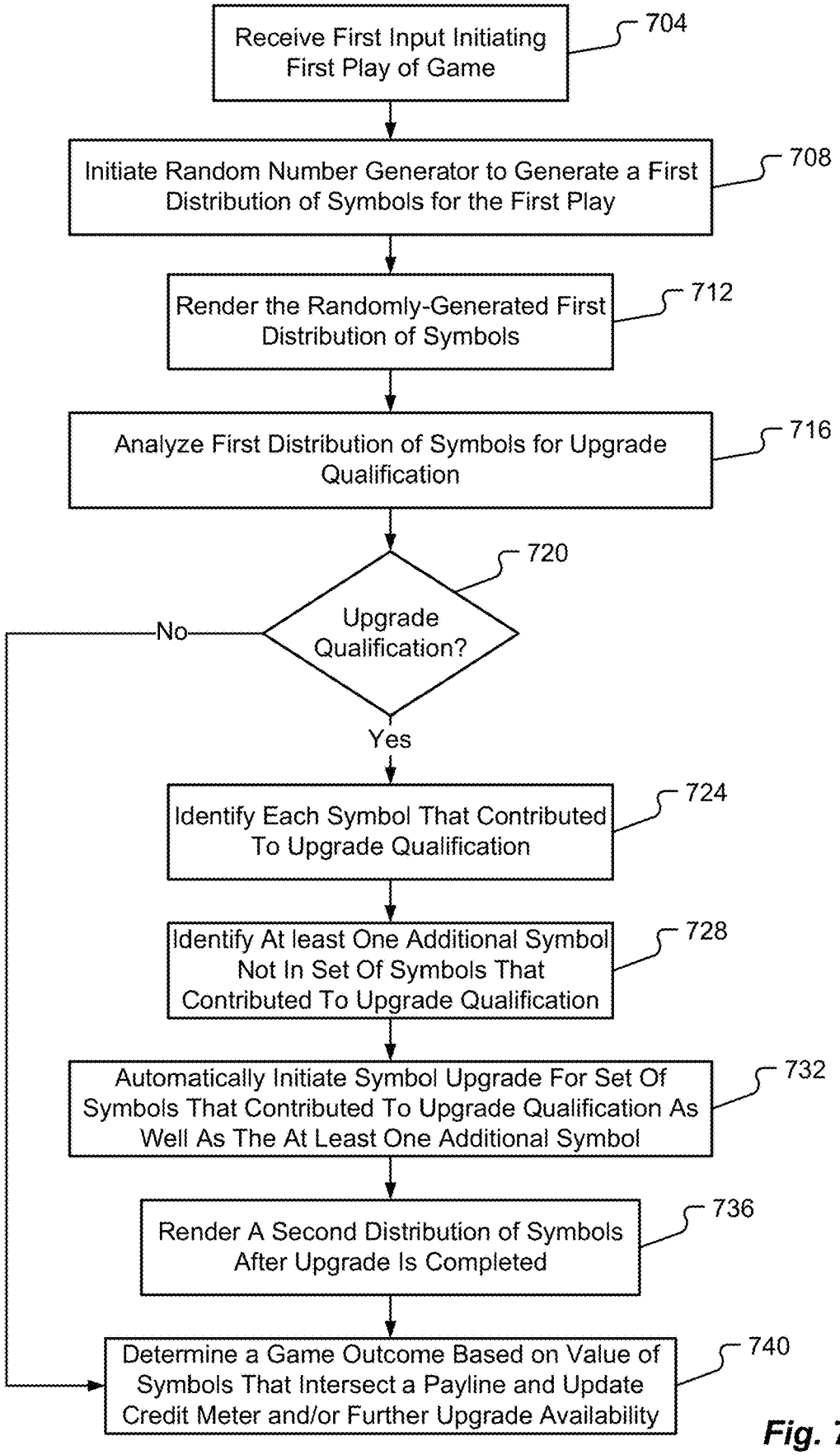
FIG. 7 is a flow diagram of an example process for enabling a symbol upgrade operation in a game.

Referring initially to FIG. 7, an example process for enabling a symbol upgrade operation in a game and for evaluating an outcome of a game will be described in accordance with at least some embodiments of the present disclosure. The process begins when a first input is received at the computational device 100 (step 704). The first input may correspond to a player input provided to any one of the input or input/output devices included in the computational device 100. The first input may correspond to a simple press of a button, a press of a screen, a pull of a lever, or any other gesture that is recognizable by the computational device 100. The first input may also include any action performed by the player, which may include a card in action, a coin in action, a ticket in action, etc.

In response to receiving the input, the process continues with the game instructions 220 requesting an output from the RNG 240 and then using the output received from the RNG 240 to generate a first distribution of symbols 316 for a first play (step 708). The first distribution of symbols 316 may correspond to an initial spin during gameplay, a bonus spin, or any other activity supported by the game instructions 220.

The first distribution of symbols may then be rendered by the computational device 100 for display to a player of the computational device 100 (step 712). In some embodiments, the first distribution of symbols may be analyzed by the game instructions 220 to determine if any cells 312 in the array of cells 304 includes symbols of a common type (step 716). The analysis may initially be performed by searching all symbols 316 in the first distribution of symbols 316 for common symbol types and then evaluating whether or not the cells 312 containing the common symbol types are adjacent to one another (e.g., diagonal, laterally, vertically, across a payline 120, etc.). In another approach, the analysis of step 716 may be performed by analyzing all adjacent cells 312 to determine if any adjacent cells 312 include a common symbol type.

If the game instructions 220 identify two or more adjacent cells as including a common symbol type, then the game instructions 220 invoke the symbol upgrade instructions 228 to determine if an upgrade should be performed (step 720). In this step, the symbol upgrade instructions 228 may determine whether a single symbol upgrade will be performed (e.g., whether symbols 316 of one symbol type will be upgraded to a next more valuable symbol type) or whether a multi-upgrade will be performed (e.g., whether symbols of one symbol type will be upgraded more than once). In this step, the symbol upgrade instructions 228 may request an output from the RNG 240 to determine whether and how many upgrades will be performed and for which symbol types the upgrade(s) will be performed. Alternatively, the symbol upgrade instructions 228 may reference the weighted upgrade table 236 to determine whether and how many upgrades will be performed and for which symbol types the upgrade(s) will be performed. The determination in step 720 may be made in a single instance, even for a multi-upgrade decision, or the decision in step 720 may be made sequentially after each upgrade has completed.

If the symbol upgrade instructions 232 determine that no symbol upgrade will occur, then the process is given back to the game instructions 220 to determine a game outcome based on a value of symbols 316 (e.g., as determined by their corresponding symbol type, with reference to a pay table, and a wager placed prior to the spin) that intersect a payline 120 (step 740). In some embodiments where the game outcome corresponds to a win or valuable outcome, then the game instructions 220 may update a credit meter 224 to reflect the value of the win. The game instructions 220 may also analyze the distribution of cells 304 to determine if a bonus spin is available and/or determine if any other game outcome should be acted upon.

Referring back to step 720, if the symbol upgrade instructions 228 determine that one or multiple symbol upgrades should be performed, then the symbol upgrade instructions 228 may identify each symbol 316 that contributed to the upgrade qualification (step 724). For instance, if the upgrade qualification was earned based on two, three, four, or more adjacent cells 312 having a symbol 316 of the same type, then each symbol 316 populating those cells 312 may be identified in step 724.

The symbol upgrade instructions 228 may also identify at least one additional symbol 316 not in the set of symbols that contributed to the upgrade qualification as a candidate symbol 316 for upgrade (step 728). In some embodiments, the at least one additional symbol 316 may become a candidate for the upgrade if the symbol 316 is of the same type as the other symbols that contributed to the upgrade qualification. Alternatively or additionally, the at least one additional symbol 316 may become a candidate for the upgrade during processing of the multi-upgrade (e.g., the symbol upgrade wave). In other words, a symbol 316 not contributing to the upgrade qualification may not necessarily be involved in a first symbol upgrade, but the symbol 316 may be involved in a later or additional symbol upgrade that occurs after the initial symbol upgrade.

The symbol upgrade instructions 228 may then automatically initiate the symbol upgrade or multi-upgrade for the set of symbols 316 that contributed to the upgrade qualification as well as the at least one additional symbol 316 that did not contribute to the upgrade qualification (step 732). The symbol upgrade instructions 228 may then invoke the user interaction instructions 232, which render a second, third, fourth, . . . , etc. distribution of symbols to depict the upgrade(s) (step 736). In some embodiments, a single upgrade and associated animation may be depicted. In some embodiments, multiple upgrades and associated animations may be depicted sequentially, thereby providing the player with an enhanced sense of excitement and anticipation.

Once all upgrades have completed, the process may continue to step 740 where the game instructions 220 determine the game outcome and update a credit meter 224 as appropriate (step 740).

Figure 8:
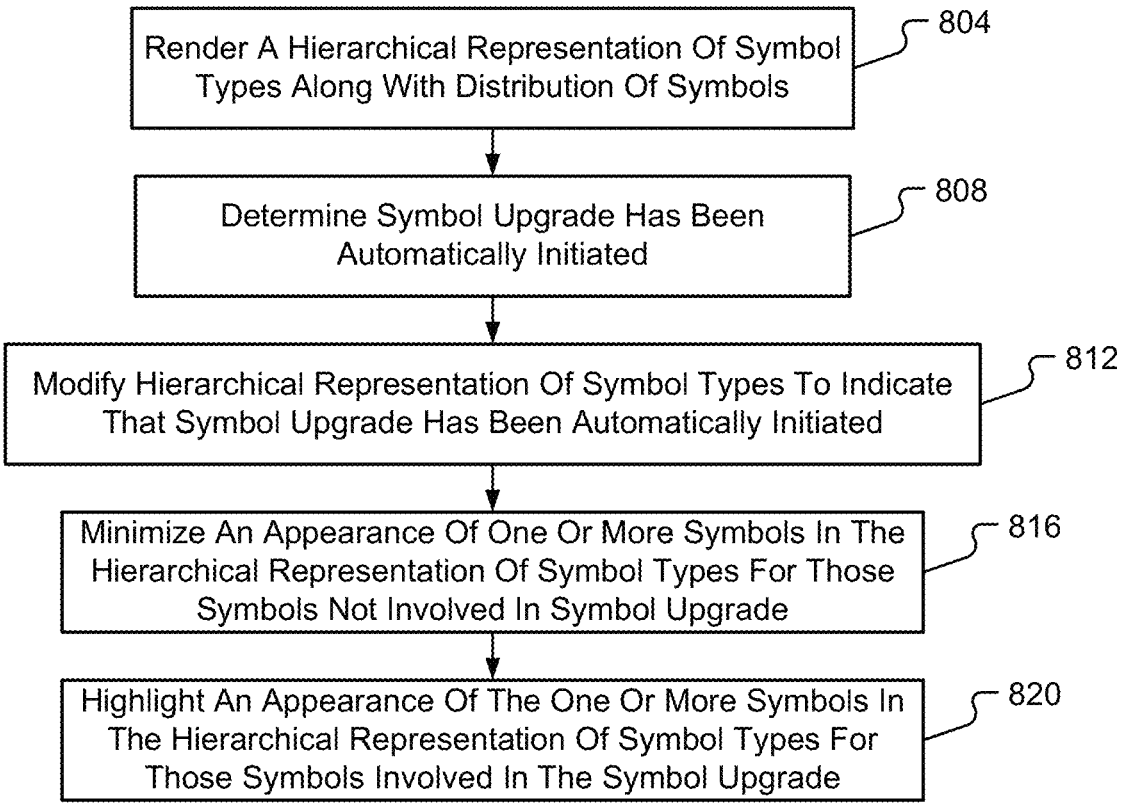
FIG. 8 is a flow diagram of an example process for utilizing a hierarchical representation of symbol types during one or multiple symbol upgrades.

Referring now to FIG. 8, a flow diagram of an example process for utilizing a hierarchical representation of symbol types 608 during one or multiple symbol upgrades will be described in accordance with at least some embodiments of the present disclosure. The process begins with the user interaction instructions 232 rendering a hierarchical representation of symbol types 608 along with a distribution of symbols 316 in an array of cells 304 (step 804). The process may continue when the symbol upgrade instructions 228 determine that a symbol upgrade or multi-upgrade is being implemented. Information regarding the symbol upgrade or multi-upgrade may be provided to the user interaction instructions 232 (step 808).

In response to determining that a symbol upgrade or multi-upgrade has been initiated, the user interaction instructions 232 may identify symbol types that are involved in the upgrade(s) and/or symbol types that are not involved in the upgrade(s). The user interaction instructions 232 may then modify the hierarchical representation of symbol types 608 to indicate that the symbol upgrade has begun (step 812). The user interaction instructions 232 may also adjust an appearance or presentation of symbol types in the hierarchical representation of symbol types to help the player understand the nature of the symbol upgrade(s) and opportunities associated therewith. For instance, the user interaction instructions 232 may minimize an appearance of symbol types for those symbol types not involved in one or any symbol upgrade (step 816). Alternatively or additionally, the user interaction instructions 232 may highlight an appearance of one or more symbol types that are involved in the symbol upgrade(s) (step 820).

Various options are also contemplated. For instance, embodiments described herein contemplate providing an option where the symbol that is attempting to be upgraded to (e.g., a candidate upgrade symbol) may be based on the remaining symbols in the hierarchy. For instance, if only Salmon and Wild symbols remain active in the hierarchy, a Salmon may attempt to upgrade to Wild symbol. Thus, the Wild symbol may provide an additional upgrade option for any symbol.

A number of variations and modifications of the disclosure can be used. It would be possible to provide for some features of the disclosure without providing others.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices. Moreover, an EGM as used herein refers to any suitable electronic gaming machine which enables a player to play a game (including but not limited to a game of chance, a game of skill, and/or a game of partial skill) to potentially win one or more awards, wherein the EGM comprises, but is not limited to: a slot machine, a video poker machine, a video lottery terminal, a terminal associated with an electronic table game, a video keno machine, a video bingo machine located on a casino floor, a sports betting terminal, or a kiosk, such as a sports betting kiosk.

In various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, "EGM" as used herein represents one EGM or a plurality of EGMs, "personal gaming device" as used herein represents one personal gaming device or a plurality of personal gaming devices, and "central server, central controller, or remote host" as used herein represents one central server, central controller, or remote host or a plurality of central servers, central controllers, or remote hosts.

As noted above, in various embodiments, the gaming system includes an EGM (or personal gaming device) in combination with a central server, central controller, or remote host. In such embodiments, the EGM (or personal gaming device) is configured to communicate with the central server, central controller, or remote host through a data network or remote communication link. In certain such embodiments, the EGM (or personal gaming device) is configured to communicate with another EGM (or personal gaming device) through the same data network or remote communication link or through a different data network or remote communication link. For example, the gaming system includes a plurality of EGMs that are each configured to communicate with a central server, central controller, or remote host through a data network.

In certain embodiments in which the gaming system includes an EGM (or personal gaming device) in combination with a central server, central controller, or remote host, the central server, central controller, or remote host is any suitable computing device (such as a server) that includes at least one processor and at least one memory device or data storage device. As further described herein, the EGM (or personal gaming device) includes at least one EGM (or personal gaming device) processor configured to transmit and receive data or signals representing events, messages, commands, or any other suitable information between the EGM (or personal gaming device) and the central server, central controller, or remote host. The at least one processor of that EGM (or personal gaming device) is configured to execute the events, messages, or commands represented by such data or signals in conjunction with the operation of the EGM (or personal gaming device). Moreover, the at least one processor of the central server, central controller, or remote host is configured to transmit and receive data or signals representing events, messages, commands, or any other suitable information between the central server, central controller, or remote host and the EGM (or personal gaming device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal gaming device). Further, one, more than one, or each of the functions of the at least one processor of the EGM (or personal gaming device) may be performed by the at least one processor of the central server, central controller, or remote host.

In certain such embodiments, computerized instructions for controlling any games (such as any primary or base games and/or any secondary or bonus games) displayed by the EGM (or personal gaming device) are executed by the central server, central controller, or remote host. In such "thin client" embodiments, the central server, central controller, or remote host remotely controls any games (or other suitable interfaces) displayed by the EGM (or personal gaming device), and the EGM (or personal gaming device) is utilized to display such games (or suitable interfaces) and to receive one or more inputs or commands. In other such embodiments, computerized instructions for controlling any games displayed by the EGM (or personal gaming device) are communicated from the central server, central controller, or remote host to the EGM (or personal gaming device) and are stored in at least one memory device of the EGM (or personal gaming device). In such "thick client" embodiments, the at least one processor of the EGM (or personal gaming device) executes the computerized instructions to control any games (or other suitable interfaces) displayed by the EGM (or personal gaming device).

In various embodiments in which the gaming system includes a plurality of EGMs (or personal gaming devices), one or more of the EGMs (or personal gaming devices) are thin client EGMs (or personal gaming devices) and one or more of the EGMs (or personal gaming devices) are thick client EGMs (or personal gaming devices). In other embodiments in which the gaming system includes one or more EGMs (or personal gaming devices), certain functions of one or more of the EGMs (or personal gaming devices) are implemented in a thin client environment, and certain other functions of one or more of the EGMs (or personal gaming devices) are implemented in a thick client environment. In one such embodiment in which the gaming system includes an EGM (or personal gaming device) and a central server, central controller, or remote host, computerized instructions for controlling any primary or base games displayed by the EGM (or personal gaming device) are communicated from the central server, central controller, or remote host to the EGM (or personal gaming device) in a thick client configuration, and computerized instructions for controlling any secondary or bonus games or other functions displayed by the EGM (or personal gaming device) are executed by the central server, central controller, or remote host in a thin client configuration.

In certain embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include a local area network (LAN) in which the EGMs (or personal gaming devices) are located substantially proximate to one another and/or the central server, central controller, or remote host. In one example, the EGMs (or personal gaming devices) and the central server, central controller, or remote host are located in a gaming establishment or a portion of a gaming establishment.

In other embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include a wide area network (WAN) in which one or more of the EGMs (or personal gaming devices) are not necessarily located substantially proximate to another one of the EGMs (or personal gaming devices) and/or the central server, central controller, or remote host. For example, one or more of the EGMs (or personal gaming devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal gaming devices) are located. In certain embodiments in which the communication network includes a WAN, the gaming system includes a central server, central controller, or remote host and an EGM (or personal gaming device) each located in a different gaming establishment in a same geographic area, such as a same city or a same state. Gaming systems in which the communication network includes a WAN are substantially identical to gaming systems in which the communication network includes a LAN, though the quantity of EGMs (or personal gaming devices) in such gaming systems may vary relative to one another.

In further embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include an internet (such as the Internet) or an intranet. In certain such embodiments, an Internet browser of the EGM (or personal gaming device) is usable to access an Internet game page from any location where an Internet connection is available. In one such embodiment, after the EGM (or personal gaming device) accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique player name and password combination assigned to the player. The central server, central controller, or remote host may, however, identify the player in any other suitable manner, such as by validating a player tracking identification number associated with the player; by reading a player tracking card or other smart card inserted into a card reader; by validating a unique player identification number associated with the player by the central server, central controller, or remote host; or by identifying the EGM (or personal gaming device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal gaming device). Examples of implementations of Internet-based gaming are further described in U.S. Pat. No. 8,764,566, entitled "Internet Remote Game Server," and U.S. Pat. No. 8,147,334, entitled "Universal Game Server."

The central server, central controller, or remote host and the EGM (or personal gaming device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal gaming devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

As should be appreciated by one skilled in the art, aspects of the present disclosure have been illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure have been described herein with reference to flowchart illustrations and/or block diagrams of methods, apparatuses (systems) and computer program products according to embodiments of the disclosure. It should be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

What is claimed is:

1. A gaming device, comprising:

a display;

a processor coupled to the display; and a memory coupled with the processor and storing therein instructions that, when executed by the processor, cause the processor to:

initiate a first play of a game, wherein the game comprises an array of cells;

render, by the display in response to initiating the first play of the game, a first distribution of symbols in the array of cells, wherein each cell in the array of cells comprises a discrete symbol in the first distribution of symbols;

determine, based on an arrangement of a set of symbols in the first distribution of symbols, that the first distribution of symbols qualifies for a symbol upgrade;

identify, in response to determining that the first distribution of symbols qualifies for the symbol upgrade, each symbol in the set of symbols as well as at least one additional symbol not in the set of symbols to upgrade from a first symbol type to a second symbol type, wherein the set of symbols and the at least one additional symbol not in the set of symbols all comprise the first symbol type prior to the symbol upgrade and then comprise the second symbol type following the symbol upgrade;

automatically initiate the symbol upgrade in response to identifying each symbol in the set of symbols as well as the at least one additional symbol not in the set of symbols;

render, by the display in response to the symbol upgrade, a second distribution of symbols in the array of cells, wherein the second distribution of symbols comprises the second symbol type for each symbol in the set of symbols as well as the at least one additional symbol not in the set of symbols, wherein the set of symbols in the first distribution of symbols occupy adjacent cells in the array of cells, and wherein the at least one additional symbol not in the set of symbols occupies a cell that is not adjacent to the cells comprising the set of symbols;

render a hierarchical representation of the first symbol type and the second symbol type; and modify the hierarchical representation of the first symbol type and the second symbol type in concert with the symbol upgrade to indicate that the symbol upgrade has been automatically initiated.

2. The gaming device of claim 1, wherein the instructions further cause the processor to:

generate a game outcome based on the second distribution of symbols in the array of cells; and update a credit meter based on the game outcome.

3. The gaming device of claim 2, wherein generating the game outcome comprises:

determining a location of a payline;

evaluating a combination of symbols in the second distribution of symbols that intersect the payline; and updating the credit meter based on a value associated with the combination of symbols in the second distribution of symbols that intersect the payline.

4. The gaming device of claim 1, wherein the second symbol type comprises a higher value than the first symbol type.

5. The gaming device of claim 1, wherein the instructions further cause the processor to:

highlight an appearance of one or more symbols in the hierarchical representation for those symbols not involved in the symbol upgrade.

6. The gaming device of claim 1, wherein the hierarchical representation comprises an ordered listing of symbols wherein the instructions further cause the processor to:

minimize an appearance of a third symbol type in the hierarchical representation relative to the first symbol type and second symbol type to indicate that the third symbol type is not involved in the symbol upgrade.

7. The gaming device of claim 6, wherein minimizing the appearance of the third symbol type comprises removing the third symbol type from the hierarchical representation.

8. The gaming device of claim 1, further comprising:

a wireless network interface.

9. The gaming device of claim 1, wherein the second distribution of symbols comprises no symbols of the first symbol type.

10. The gaming device of claim 1, wherein the first distribution of symbols is determined based on an output of a random number generator (RNG) and each symbol in the set of symbols as well as at least one additional symbol not in the set of symbols is upgraded from the first symbol type to the second symbol type using a weighted upgrade table.

11. The gaming device of claim 1, wherein the first distribution of symbols is determined based on a first output of a random number generator (RNG) and each symbol in the set of symbols as well as at least one additional symbol not in the set of symbols is upgraded from the first symbol type to the second symbol type based on a second output of the RNG.

12. The gaming device of claim 1, wherein the instructions further cause the processor to:

determine, based on an arrangement of a second set of symbols in the second distribution of symbols, that the second distribution of symbols qualifies for an additional symbol upgrade;

identify, in response to determining that the second distribution of symbols qualifies for the additional symbol upgrade, each symbol in the second set of symbols to upgrade from the second symbol type to a third symbol type;

automatically initiate the additional symbol upgrade in response to identifying each symbol in the second set of symbols; and render, by the display in response to the additional symbol upgrade, a third distribution of symbols in the array of cells, wherein the third distribution of symbols comprises the third symbol type for each symbol in the second set of symbols.

13. The gaming device of claim 1, wherein the second symbol type comprises a wild symbol.

14. A method, comprising:

initiating, with a processor, a first play of a game, wherein the game comprises an array of cells;

rendering, on a display and in response to initiating the first play of the game, a first distribution of symbols in the array of cells, wherein each cell in the array of cells comprises a discrete symbol in the first distribution of symbols;

determining, with the processor and based on an arrangement of a set of symbols in the first distribution of symbols, that the first distribution of symbols qualifies for a symbol upgrade, wherein the set of symbols comprise a first symbol type;

identifying, with the processor and in response to determining that the first distribution of symbols qualifies for the symbol upgrade, each symbol in the first distribution of symbols that comprises the first symbol type;

automatically performing, with the processor, the symbol upgrade, wherein each symbol in the set of symbols as well as at least one additional symbol not in the set of symbols are upgraded from the first symbol type to a second symbol type, wherein the set of symbols and the at least one additional symbol not in the set of symbols all comprise the first symbol type prior to the symbol upgrade and then comprise the second symbol type following the symbol upgrade;

rendering, on the display and in response to the symbol upgrade, a second distribution of symbols in the array of cells, wherein the second distribution of symbols comprises the second symbol type for each symbol in the set of symbols as well as the at least one additional symbol not in the set of symbols, wherein the set of symbols in the first distribution of symbols occupy adjacent cells in the array of cells, and wherein the at least one additional symbol not in the set of symbols occupies a cell that is not adjacent to the cells comprising the set of symbols;

rendering a hierarchical representation of the first symbol type and the second symbol type; and modifying the hierarchical representation of the first symbol type and the second symbol type in concert with the symbol upgrade to indicate that the symbol upgrade has been automatically initiated.

15. The method of claim 14, further comprising:

determining, with the processor, a location of a payline relative to the array of cells;

evaluating, with the processor, a combination of symbols in the second distribution of symbols that intersect the payline; and updating a credit meter based on a value associated with the combination of symbols in the second distribution of symbols that intersect the payline, wherein the second symbol type comprises a higher value than the first symbol type.

16. The method of claim 14, further comprising:

highlighting an appearance of one or more symbols in the hierarchical representation for those symbols not involved in the symbol upgrade.

17. The method of claim 14, further comprising:

minimizing an appearance of symbols types in the hierarchical representation that are not involved in the symbol upgrade.

18. The method of claim 14, wherein the first distribution of symbols is determined based on an output of a random number generator (RNG) and each symbol in the set of symbols as well as at least one additional symbol not in the set of symbols is upgraded from the first symbol type to the second symbol type using a weighted upgrade table.

19. The method of claim 14, wherein the first distribution of symbols is determined based on a first output of a random number generator (RNG) and each symbol in the set of symbols as well as at least one additional symbol not in the set of symbols is upgraded from the first symbol type to the second symbol type based on a second output of the RNG.

20. A system, comprising:

a processor; and a memory, coupled with the processor, comprising instructions that are executable by the processor, wherein the instructions comprise instructions that:

initiate a first play of a game, wherein the game comprises an array of cells;

cause a first distribution of symbols to be displayed in the array of cells, wherein each cell in the array of cells comprises a discrete symbol in the first distribution of symbols;

determine, based on an arrangement of a set of symbols in the first distribution of symbols, that the first distribution of symbols qualifies for a symbol upgrade, wherein every symbol in the set of symbols comprises a first symbol type and wherein the set of symbols occupy adjacent cells in the array of cells;

identify, in response to determining that the first distribution of symbols qualifies for the symbol upgrade, each symbol in the first distribution of symbols that comprises the first symbol type;

perform the symbol upgrade such that each symbol in the set of symbols as well as at least one additional symbol not in the set of symbols are upgraded from the first symbol type to a second symbol type, wherein the set of symbols and the at least one additional symbol not in the set of symbols all comprise the first symbol type prior to the symbol upgrade and then comprise the second symbol type following the symbol upgrade;

cause a second distribution of symbols to be displayed in the array of cells, wherein the second distribution of symbols comprises the second symbol type for each symbol in the set of symbols as well as the at least one additional symbol not in the set of symbols, wherein the set of symbols in the first distribution of symbols occupy adjacent cells in the array of cells, and wherein the at least one additional symbol not in the set of symbols occupies a cell that is not adjacent to the cells comprising the set of symbols;

render a hierarchical representation of the first symbol type and the second symbol type; and modify the hierarchical representation of the first symbol type and the second symbol type in concert with the symbol upgrade to indicate that the symbol upgrade has been automatically initiated.

* * * * *